US009100759B2

(12) United States Patent
Citerin

(10) Patent No.: US 9,100,759 B2
(45) Date of Patent: Aug. 4, 2015

(54) LOUDSPEAKER DRIVER WITH SENSING COILS FOR SENSING THE POSITION AND VELOCITY OF A VOICE-COIL

(71) Applicant: CANON KABUSHIKI KAISHA, Tokyo (JP)

(72) Inventor: Johann Citerin, Cesson-Sevigne (FR)

(73) Assignee: Canon Kabushiki Kaisha, Tokyo (JP)

( * ) Notice: Subject to any disclaimer, the term of this patent is extended or adjusted under 35 U.S.C. 154(b) by 311 days.

(21) Appl. No.: 13/757,584

(22) Filed: Feb. 1, 2013

(65) Prior Publication Data

US 2013/0202122 A1 Aug. 8, 2013

(30) Foreign Application Priority Data

Feb. 3, 2012 (GB) ..... 1201938

(51) Int. Cl.
*H04R 29/00* (2006.01)
*H04R 3/00* (2006.01)
*H04R 3/04* (2006.01)

(52) U.S. Cl.
CPC ..... *H04R 29/001* (2013.01); *H04R 3/007* (2013.01); *H04R 3/04* (2013.01)

(58) Field of Classification Search
CPC ..... H04R 29/001; H04R 3/007; H04R 3/04
USPC ..... 381/55, 58, 59, 96, 386, 401
See application file for complete search history.

(56) References Cited

U.S. PATENT DOCUMENTS

| | | | | |
|---|---|---|---|---|
| 4,276,443 | A | 6/1981 | Meyers | |
| 4,550,430 | A | 10/1985 | Meyers | |
| 5,828,767 | A * | 10/1998 | Button | 381/401 |
| 2002/0159606 | A1 * | 10/2002 | Hobelsberger | 381/96 |
| 2003/0021427 | A1 | 1/2003 | Nakada et al. | |
| 2009/0028371 | A1 * | 1/2009 | Bailey | 381/386 |

FOREIGN PATENT DOCUMENTS

| | | | |
|---|---|---|---|
| GB | 2010639 | A | 6/1979 |
| GB | 2342001 | A | 3/2000 |
| WO | WO84/00274 | A1 | 1/1984 |

* cited by examiner

*Primary Examiner* — Vivian Chin
*Assistant Examiner* — Friedrich W Fahnert
(74) *Attorney, Agent, or Firm* — Canon U.S.A. Inc., IP Division

(57) ABSTRACT

This invention concerns a loudspeaker driver includes at least one actuator connected to a vibrating support to impart excitation to the latter when caused to move, wherein the loudspeaker driver further includes a plurality of sensing members arranged to move with the at least one actuator, each sensing member providing output sensing data dependent on the velocity of said at least one actuator, and means for determining the position of the at least one actuator based on at least one ratio (X/Y) of output sensing data or of linear combinations of output sensing data provided from the plurality of sensing members, said at least one ratio being independent of the velocity of the at least one actuator.

32 Claims, 11 Drawing Sheets

LOUDSPEAKER DRIVER WITH SENSING COILS FOR SENSING THE POSITION AND VELOCITY OF A VOICE-COIL

CROSS-REFERENCE TO RELATED APPLICATIONS

This application claims priority to and benefit of United Kingdom patent application N° GB1201938.6 filed 3 Feb. 2012, the disclosure of which is incorporated in its entirety.

BACKGROUND OF THE INVENTION

The invention concerns a loudspeaker driver.

Typically, a loudspeaker driver comprises a membrane as a vibrating support that vibrates when excited and a motor which is formed of a voice-coil immersed in a magnetic field created by a permanent magnet. The voice-coil is connected to the membrane. In operation, an oscillatory motion is imparted to the voice-coil which moves within the magnetic gap of the magnet and this motion (excitation) is transmitted to the membrane. When thus excited, the membrane vibrates and generates a sound in a given range of frequencies.

Nowadays, active loudspeaker drivers represent an attractive emerging trend. In particular, active loudspeaker drivers may be useful to compensate for the non-linear behaviour of conventional passive loudspeaker drivers. Indeed, such a behaviour is mainly responsible for sound distortion which is one of the worst limitations of conventional passive loudspeaker drivers.

Nevertheless, active loudspeaker drivers are not frequently used in the audio field since they were found to be expensive and fragile. They need sensors to work, especially for determining the position and the velocity of displacement of the loudspeaker membrane, and conventional sensors are relatively bulky, expensive, heavy, fragile, prone to failure, and/or do not easily fit with the modern design of loudspeaker drivers.

There is thus a need to accurately sense the position and the velocity of a vibrating support or of a voice-coil in a loudspeaker driver. There is also a need to perform real-time sensing of the position and the velocity in order to operate for example the active loudspeaker driver.

As an example, those needs appear in the field of the subwoofer loudspeaker drivers which are featured by low frequencies up to 200 Hz. Such loudspeaker drivers exhibit large membrane displacements which would be desirable to be sensed.

Sensing such displacements would make it possible to envisage for example the following applications:

correction of distortion, performance enhancement, protection of the loudspeaker driver, adaptation to pressure, temperature, and/or any other environmental change.

U.S. Pat. No. 5,197,104 describes a complex system used in a loudspeaker driver.

More particularly, it includes a voice-coil connected to a membrane and immersed in the magnetic field created by a main magnetic circuit. A sensing coil connected to the membrane, and at distance from the voice-coil, is immersed in the magnetic field created by an additional magnetic circuit. An oscillating circuit is connected to the sensing coil and its oscillation frequency changes with the electrical impedance of the sensing coil circuit. The oscillation frequency is converted into a voltage signal, which is then processed in order to modify the input signal to the voice-coil so as to reduce distortion.

The sensing system disclosed therein is not satisfactory as it is first not adapted to directly sense the position and the velocity but relies on the system impedance. It furthermore requires an additional dedicated magnetic circuit which represents a bulky, heavy and expensive solution. Also, the velocity and position information are difficult to derive independently from the sole impedance.

Having the foregoing in mind, it would then be desirable to efficiently and easily determine the position and/or the velocity of a loudspeaker vibrating support.

BRIEF SUMMARY OF THE INVENTION

According to an aspect of the invention, a loudspeaker driver comprises:

at least one actuator connected to a vibrating support to impart excitation to the latter when caused to move, wherein the loudspeaker driver further comprises:

a plurality of sensing members arranged to move with the at least one actuator, each sensing member providing output sensing data dependent on the velocity of said at least one actuator, and means for determining the position of the at least one actuator based on at least one ratio (X/Y) of output sensing data or of linear combinations of output sensing data provided from the plurality of sensing members, said at least one ratio being independent of the velocity of the at least one actuator.

The output sensing data provided by the sensing members are dependent on the velocity of the sensing members and, therefore of the actuator and the vibrating support. Output sensing data provided by the sensing members or at least some of them are directly used and not converted into an intermediary value/parameter before deriving the actuator position.

According to the invention, the at least one ratio X/Y of output sensing data (e.g. voltages produced by sensing members respectively) or of linear combinations of output sensing data that is used is chosen so as to get rid of the actuator velocity in the formula and then the ratio does no longer depend on the actuator velocity but on the actuator position only. This greatly simplifies the actuator position determination and enhances its accuracy.

Thus, the invention makes it possible to determine the position of the at least one actuator from one or several ratios that have been previously suitably chosen in order for the chosen ratio or ratios to be independent of the velocity of the at least one actuator.

The loudspeaker driver according to the invention also proves to be cheap and of simple conception.

In particular, it does not need any additional magnetic circuit as in the prior art.

According to a possible feature, the position of the at least one actuator within the whole range of actuator positions is based on at least two ratios of sensing members output sensing data, each ratio covering a portion of the whole range of actuator positions.

Thus, according to the position of the at least one actuator in the whole range of positions several different ratios may be used so as to cover the whole range.

Depending on the actuator position one ratio is more suited than another one.

It is to be noted that the invention therefore makes it possible to determine the position of the at least one actuator over the whole range of positions contrary to prior art solutions.

According to another possible feature, the given sensing member appearing in the above ratios is selected according to a predetermined criterion which may vary depending on the applications, the loudspeaker configuration and the number and locations of the sensing members.

Overall, the sensing member which is selected is the sensing member for which the ratio Ui/Yj is the most indicative of the actuator position.

According to a possible feature, the sensing member which is selected is the sensing member for which the ratio X/Y (e.g. Ui/Yj) is substantially linear as a function of the at least one actuator position over a portion of the whole range of actuator positions.

It is to be noted that several sensing members may be selected so as to cover the whole range of actuator positions or at least its main part.

Thus, by way of example, a first sensing member may be selected to determine the actuator position over a first predetermined range of positions through the ratio U1/Y, whereas a second sensing member may be selected to determine the actuator position over a second predetermined range of positions through the ratio U2/Y. These two ranges may overlap or not and Y may assume one of the above-mentioned shapes (e.g. the sum of the output sensing data of the plurality of sensing members).

According to a possible feature, the loudspeaker driver comprises means for determining the velocity of the at least one actuator in accordance with the determined position thereof.

The determined position is thus used to determine the velocity of the at least one actuator (and of the vibrating support).

The position is not used as the only input to the velocity determining means but is used in order to improve the accuracy of the calculation (due to non-linear effects depending on the position).

According to a further possible feature, the loudspeaker driver comprises means for determining the velocity of the at least one actuator that is axially moving within a magnetic gap of the loudspeaker driver based on the determined position of said at least one actuator and at least some of the sensing members output sensing data.

For example, the velocity may be dependent on a ratio of the sum of all the sensing members output sensing data divided by the radial magnetic field value within the magnetic gap.

According to a possible feature, the position of the at least one actuator is determined based on at least one ratio X/Y, where X stands for output sensing data provided by a given sensing member or by a linear combination of sensing members output sensing data and Y stands for output sensing data provided by any other sensing member or any other linear combination of sensing members output sensing data, the output sensing data at the numerator and the denominator having the same power. The ratio or ratios given as examples above are chosen so as to be independent from the actuator velocity.

By way of example, said at least one ratio (X/Y) may be selected among the following:

X and Y respectively stand for output sensing data Ui and Uj provided by two different sensing members, X/Y being then equal to Ui/Uj;

X stands for output sensing data Ui provided by a given sensing member and Y stands for a given linear combination of output sensing data provided by at least two sensing members;

X and Y respectively stand for two different linear combinations of sensing members output sensing data, each linear combination having the same power;

X stands for $Ui^n$, where Ui stands output sensing data provided by a given sensing member and n>1, and Y stands for a given linear combination of output sensing data provided by at least two sensing members with the same power n.

According to several possible features:

the plurality of sensing members is a plurality of sensing coils; these sensing members are contactless, cheap, simple of conception and compact;

the at least one actuator is a voice-coil.

According to a possible feature, the voice-coil as an actuator is suitable for axially moving within a magnetic gap of the loudspeaker driver and the plurality of sensing members are sensing coils connected or linked to the voice-coil, e.g. affixed thereto.

According to a possible feature, the thickness of each sensing coil is small enough so that the voice-coil equipped with the plurality of sensing coils is suitable for axially moving within the magnetic gap without mechanically interfering with the edges thereof. Thus there is no need to increase the conventional width of the gap so as to accommodate the plurality of sensing coils.

In a particular embodiment, the loudspeaker comprises three sensing coils arranged one above each other, a lower, a medium and an upper sensing coil.

The height or axial dimension of the medium sensing coil may be less than the height of the magnetic gap.

Thus, either the lower or the upper sensing coil is always in part located within the magnetic gap whatever the axial position of the voice-coil. The axial displacement of the voice-coil induces a fast variation (rise or decrease) in the value of the output sensing data provided by the lower or upper sensing coil (or of the value of ratio $Ui/U_{tot}$, where Ui is the sensing coil which is partly located within the magnetic gap). This variation is substantially linear in accordance with the displacement, which therefore makes the lower and upper sensing coils of particular interest for determining the voice-coil position.

According to a possible feature, the loudspeaker comprises means for correcting the output sensing data provided by each sensing member to take into account the inductance factor Mci between the voice-coil and each sensing member. This contributes to increasing the accuracy of the position determination and, therefore, of the velocity determination.

According to a possible feature, the at least one actuator is a voice coil, the plurality of sensing members is a plurality of sensing coils, and said loudspeaker driver further comprises:

means for obtaining the electrical current $I_c$ in the voice-coil, means for correcting the output sensing data provided by each sensing coil based on the inductance factor Mci between the voice-coil and each sensing coil and the variation of the current Ic in time, dIc/dt.

The loudspeaker may further comprise means for obtaining the inductance factor Mci between the actuator and each sensing coil.

According to a possible feature, the means for obtaining the inductance factor Mci between the voice-coil and each sensing coil more particularly comprise:

means for generating a high frequency current signal having a predetermined amplitude, the frequency being so that the velocity of the voice-coil and its displacement induces a negligible measured signal in the sensing coils, means for measuring the voltage induced across each sensing coil, and means for obtaining the inductance factor Mci based on the measured induced voltage amplitude, the predetermined current amplitude and its frequency.

By way of example, each sensing member provides a voltage signal as output sensing data but any other appropriate output sensing data may be used depending on the sensing members, their number and the loudspeaker driver configuration.

According to a further aspect, the invention concerns a method for determining the position of at least one actuator connected to a vibrating support in a loudspeaker driver, the loudspeaker driver comprising a plurality of sensing members affixed to the at least one actuator and providing each output sensing data, wherein the method comprises:

causing the at least one actuator and the plurality of sensing members to move, the output sensing data provided by each sensing member being dependent on the velocity of said at least one actuator, determining at least one ratio (X/Y) of output sensing data or of linear combinations of output sensing data provided from the plurality of sensing members, said at least one ratio being independent of the velocity of the at least one actuator, and determining the position of the at least one actuator based on the determined at least one ratio.

According to a possible feature, the method comprises beforehand a calibration step, said calibration step comprising:

causing the at least one actuator and the plurality of sensing members to move so that the at least one actuator occupies a plurality of calibration positions, measuring each position of said plurality of calibration positions, determining for each measured position a corresponding calibration ratio (X/Y) of output sensing data or of linear combinations of output sensing data provided from the plurality of sensing members, and storing a plurality of couples of values each being formed by a value of a calibration position and a value of a calibration ratio. These measurements and determination are made prior to determining the current position of the at least one actuator.

According to an alternative possible feature, the method comprises beforehand a calibration step, said calibration step comprising:

determining the radial magnetic field value Br(z) in a magnetic gap of the loudspeaker driver in which said at least one actuator is adapted to axially move, as a function of the axial position z, determining, for a plurality of calibration positions of the at least one actuator, the average magnetic field value to which each sensing member is subject to using the determined radial magnetic field value Br(z), determining, for each position of the plurality of calibration positions of the at least one actuator, a value taken by at least one function Mi depending on the determined average magnetic field values to which the plurality of sensing members are subject to in said position, the at least one function Mi establishing a correspondence between a calibration position of the at least one actuator and at least one ratio (X/Y) of output sensing data or of linear combinations of output sending data provided from the plurality of sensing members, storing the plurality of couples values each couple being formed by a value taken by the at least one function Mi (X/Y) and the corresponding calibration position.

According to a possible feature, a position of the at least one actuator is then determined in the position determining step based on the determined at least one ratio and the stored plurality of couples of values.

The position is obtained, for example, based on an interpolation method applied to the stored values.

According to another possible feature, the method comprises determining parameters of at least one polynomial function from the plurality of previously determined couples of values so as to establish said at least one polynomial function, the position of the at least one actuator being then determined from the at least one polynomial function and the determined at least one ratio.

According to a further possible feature, the method more particularly comprises determining parameters of two polynomial functions from the plurality of previously determined couples of values so as to establish said two polynomial functions, each polynomial function being adapted to cover a portion of the whole range of actuator positions, the polynomial functions being adapted to cover together the whole range of actuator positions.

Depending on the position of the at least one actuator, one polynomial function or the other is best suited for determining the least one actuator position.

The polynomial function which is the most appropriate for determining the at least one actuator position may be selected from information provided by the values of the ratio(s) of output sensing data or of the linear combinations of output sensing data and their possible direction of variation.

According to a further aspect, the invention concerns a method for determining the velocity of at least one actuator connected to a vibrating support in a loudspeaker driver, the loudspeaker driver comprising at least one sensing member affixed to the at least one actuator and providing output sensing data, wherein the method comprises:

causing the at least one actuator and the at least one sensing member to move, the output sensing data provided by the or each sensing member being dependent on the velocity of said at least one actuator, determining the output sensing data or the sum of the output sensing data $U_{tot}$ provided by the one or the plurality of sensing member(s);

determining the position of the at least one actuator; and determining the velocity of the at least one actuator based on the determined value of output sensing data or the sum of the output sensing data $U_{tot}$ and the determined position.

According to a possible feature, the method comprises beforehand a calibration step, said calibration step comprising:

causing the at least one actuator and the at least one sensing member to move so that the at least one actuator occupies a plurality of calibration positions, obtaining each position $d_c$ of said plurality of calibration positions, determining for each calibration position a calibration value $UC_{tot}$, corresponding to output sensing data or to the sum of output sensing data provided by the one or the plurality of sensing member(s), and a velocity v of the at least one actuator; and storing a plurality of triplets of values (v, $UC_{tot}$, $d_c$) formed each by one determined calibration value $UC_{tot}$, one obtained calibration position $d_c$ and the corresponding determined velocity v. The above determining and storing are carried out prior to determining the current velocity of the at least one actuator.

According to an alternative possible feature, the method comprises beforehand a calibration step, said calibration step comprising:

determining the radial magnetic field value Br(z) in a magnetic gap of the loudspeaker driver in which said at least one actuator is adapted to axially move, as a function of the axial position z, determining, for a plurality of calibration positions $d_c$ of the at least one actuator, the average overall radial magnetic field value $\langle Br\rangle_{tot}(d_c)$ to which the at least one sensing member is subject to using the determined radial magnetic field value Br(z), determining, for a plurality of calibration values of $UC_{tot}$ chosen for each position of the plurality of calibration positions, several values of the velocity v based on the plurality of values of $\langle Br\rangle_{tot}(d_c)$ and $UC_{tot}$; and storing the plurality of triplets of values (v, $UC_{tot}$, $d_c$) formed each by one chosen calibration value $UC_{tot}$, one calibration position $d_c$ and the corresponding determined velocity v.

According to a possible feature, a velocity of the at least one actuator is then determined in the step of determining the velocity based on the determined value $U_{tot}$ provided by the one or the plurality of sensing members, the determined position and the stored plurality of triplets of values (v, $UC_{tot}$, $d_c$).

This determining of the velocity current value may be made for example through an interpolation method.

BRIEF DESCRIPTION OF THE DRAWINGS

Other features and advantages will emerge from the following detailed description, which is merely given as a non-limiting example with reference to the drawings in which.

DETAILED DESCRIPTION OF THE INVENTION

Figure 1:
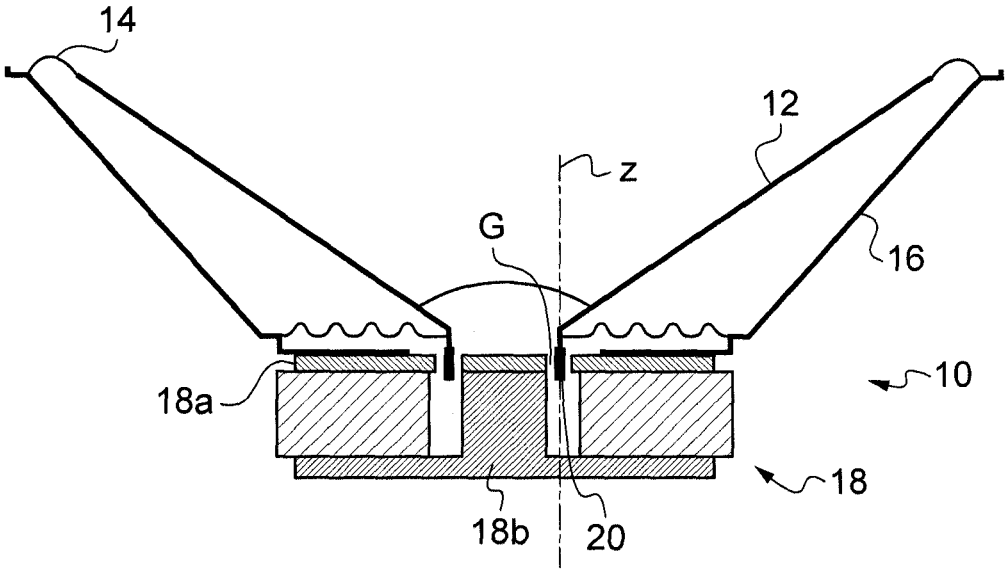
FIG. 1 schematically represents a loudspeaker driver according to the invention.

FIG. 1 illustrates a loudspeaker driver 10 which comprises a vibrating support 12 that is operable to vibrate when submitted to an excitation.

Vibrating support 12 may be a membrane which has for instance the shape of a diaphragm or a cone.

According to other embodiments, vibrating support may assume other shapes such as those of a beam or a planar circular shape (disc).

As represented in FIG. 1, vibrating support 12 is suspended at its opposite extremities or at its periphery by using passive suspending members such as surrounds 14.

The loudspeaker driver further comprises a frame or basket 16 in which vibrating support 12 is disposed, surrounds 14 suspending vibrating support 12 to frame 16.

Loudspeaker driver 10 also comprises a permanent magnet 18 to which frame 16 is fixed.

More particularly, permanent magnet 18 comprises an upper plate 18*a* on the top of which frame 16 is fixed, e.g. by gluing, and a central pole piece 18*b* defining together with upper plate 18*a* a magnetic gap G.

Loudspeaker driver 10 further comprises at least one actuator which is here for instance a voice-coil 20.

Voice-coil 20 is connected to vibrating support 12.

Voice-coil 20 is immersed in a magnetic field created by permanent magnet 18.

In the course of use of the loudspeaker driver, voice-coil 20 is caused to move in the magnetic field, in particular according to an oscillatory motion. This motion or excitation is therefore transmitted to vibrating support 12.

When thus excited, vibration support or membrane 12 vibrates and generates sound.

The magnetic field value in a loudspeaker driver depends on the axial or z position within the magnetic gap. In particular, the magnetic field value quickly decreases outside the boundaries $z_{int}$ and $z_{sup}$ of the upper plate 18*a* of the magnetic circuit of the loudspeaker driver. As a consequence, the magnetic field value can be considered as a means of knowing the position of the voice-coil (through the induced voltage) and thus of the membrane as it will be explained below.

As a coil moves in a magnetic field, an induced voltage is generated between the coil terminals (induction effect). The generated voltage depends only on the magnetic field and the coil velocity as it appears from the following:

$$U = \int_{zinf_{coil}}^{zsup_{coil}} B_r(z) * \frac{\partial L_w}{\partial z} * v_{coil} dz = L_{wire} * \langle B_r(z)\rangle * v_{coil}$$

Where:

z is the coordinate or axial position in the direction of movement of the coil, $B_r(z)$ is the radial magnetic field value as a function of z, $L_{wire}$ is the wire length of the coil and $$\frac{\partial L_w}{\partial z}$$

is the linear wire length density, $v_{coil}$ the coil velocity, and $(B_r(z))$ is the average radial magnetic field value across the coil.

It ensues that:

$U=\text{const}\cdot v_{coil}\cdot(B_r(z))$ and, therefore, the voltage U depends on $v_{coil}$ and z only.

Thus, the induction effect can be considered as a contactless sensing means for sensing both position and velocity of the coil which acts as a sensing coil. Thus, the position and the velocity of the voice-coil or the membrane can also be sensed by considering the sensing coil united to the voice-coil or to the membrane of the loudspeaker driver.

However, relying directly on the induction effect is not always possible or does not provide a satisfactory solution in terms of sensing accuracy for several reasons discussed below.

Sensing the position through the induction effect depends on the voice-coil velocity, which is unknown.

Sensing the velocity through the induction effect depends on the magnetic field, which is unknown. In the prior art, some implementations of velocity sensing use the induction effect based on the assumption that the magnetic field does not vary during the loudspeaker driver use. However, this is not a good solution since the actual magnetic field is never constant.

The induction effect is very sensitive to magnetic perturbations. The current flowing into the voice-coil creates magnetic induction on the sensing coil. This is one of the main reasons why in prior art solutions as in U.S. Pat. No. 5,197,104, the sensing coil is purposely located far away from the voice coil.

In view of the above prior art limitations, loudspeaker driver 10 of FIG. 1 further includes a plurality of sensing members 22, 24, 26 arranged to move with voice-coil 20. Each sensing member is suitable for providing output sensing data dependent on the velocity of said sensing member.

As will be explained subsequently, the position and velocity of voice-coil 20 will be determined based on at least one ratio of these output sensing data.

Figure 2:
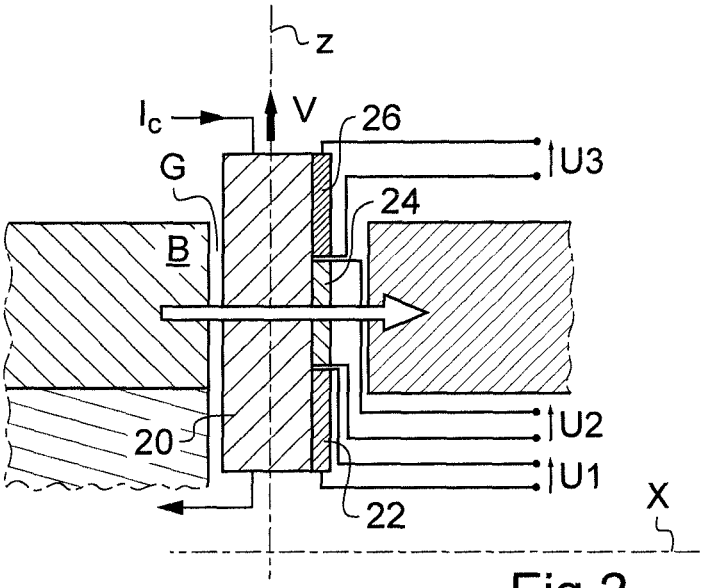
FIG. 2 is an enlarged partial schematic view of a voice-coil and a plurality of sensing coils in the loudspeaker driver of FIG. 1.

The sensing members are connected to voice-coil 20 and, for instance, affixed thereto so as to be able to move when voice-coil 20 moves within magnetic gap G (FIG. 2).

The plurality of sensing members is a plurality of sensing coils 22, 24, 26.

The thickness of each sensing coil 22, 24, 26 taken along axis X is small enough so that voice-coil 20 equipped with sensing coils 22, 24, 26 is suitable for axially moving within magnetic gap G without mechanically interfering with the edges thereof.

From a practical point of view, the thickness of each sensing coil is given by the thickness of the diameter of the wire(s) composing the coil. By suitably choosing the thickness of the wires the sensing coils can be added to any conventional loudspeaker driver with no, or at most very limited, motor design change.

Thin wires make it possible to keep the same or similar dimension along axis X for magnetic gap G. This means that the magnetic field values remain similar, thereby leading to no impact on the electromechanical performance of the loudspeaker driver.

Also, having thin wire(s) for each sensing coil makes it possible to have a longer wire length Li for a given overall sizing.

Thus, a sensing coil composed of thinner wire or wires and longer wire or wires provides higher output sensing data which, in the present embodiment, corresponds to a voltage signal.

Higher output sensing data means that the sensor is more sensitive.

In the present embodiment sensing coils 22, 24 and 26 are of equal length and are wrapped around voice-coil 20.

As schematically illustrated in FIG. 2, the three sensing coils are arranged one above each other in alignment with axis Z.

In particular, sensing coil 22 is referred to as a lower sensing coil, sensing coil 24 as a medium sensing coil and sensing coil 26 as an upper sensing coil.

The height or axial dimension (along axis Z) of medium sensing coil 24 is less than the height of magnetic gap G so that when voice-coil 20 moves within magnetic gap G at least one of lower coil 22 and upper coil 26 overlaps with a zone of high magnetic field value (within the magnetic gap) and a zone of low magnetic field value (outside the magnetic gap).

When a coil (e.g. lower coil 22 or upper coil 26) overlaps between a zone of high magnetic field value and a zone of low magnetic field value, any displacement of the coil provokes a change in the length of the coil wires that are subject to the high magnetic field value and thus in the induced voltage. This provides a means for accurately sensing the displacement of the coil. On the contrary, when a coil does not overlap between the two zones (e.g. medium coil 24 for small displacements), only a limited change in the induced voltage can be observed due to a possible small variation in the high magnetic field value within the magnetic gap.

Thus a fast variation (rise or decrease) in the value of the output sensing data (here, the electrical voltage) provided by the lower and/or upper sensing coils is obtained. The fast variation in the electrical voltage (or in a ratio of voltages or combination of voltages) is substantially linear as a function of the axial displacement d of the voice-coil 20.

Lower sensing coil 22 and upper sensing coil 26 are therefore particularly interesting since they make it possible to have linearized results and improve the accuracy in the determination of voice-coil position and velocity.

As schematically represented in FIG. 2, output sensing data provided by sensing coil 22, 24 and 26 will be referred to in the remainder of the description as U1, U2 and U3 respectively.

$I_c$ represents the electrical current which circulates within voice-coil 20.

The real-time position of actuator 20 along axis Z and its velocity are determined based on one or several ratios of output sensing data of sensing coils 22, 24 and 26.

This or these ratios involve the above output sensing data U1, U2 and U3.

Any ratio involving these output sensing data (or output sensing data of additional sensing coils) may be used provided that the ratio or ratios do not depend on the velocity of actuator 20.

Figure 3:
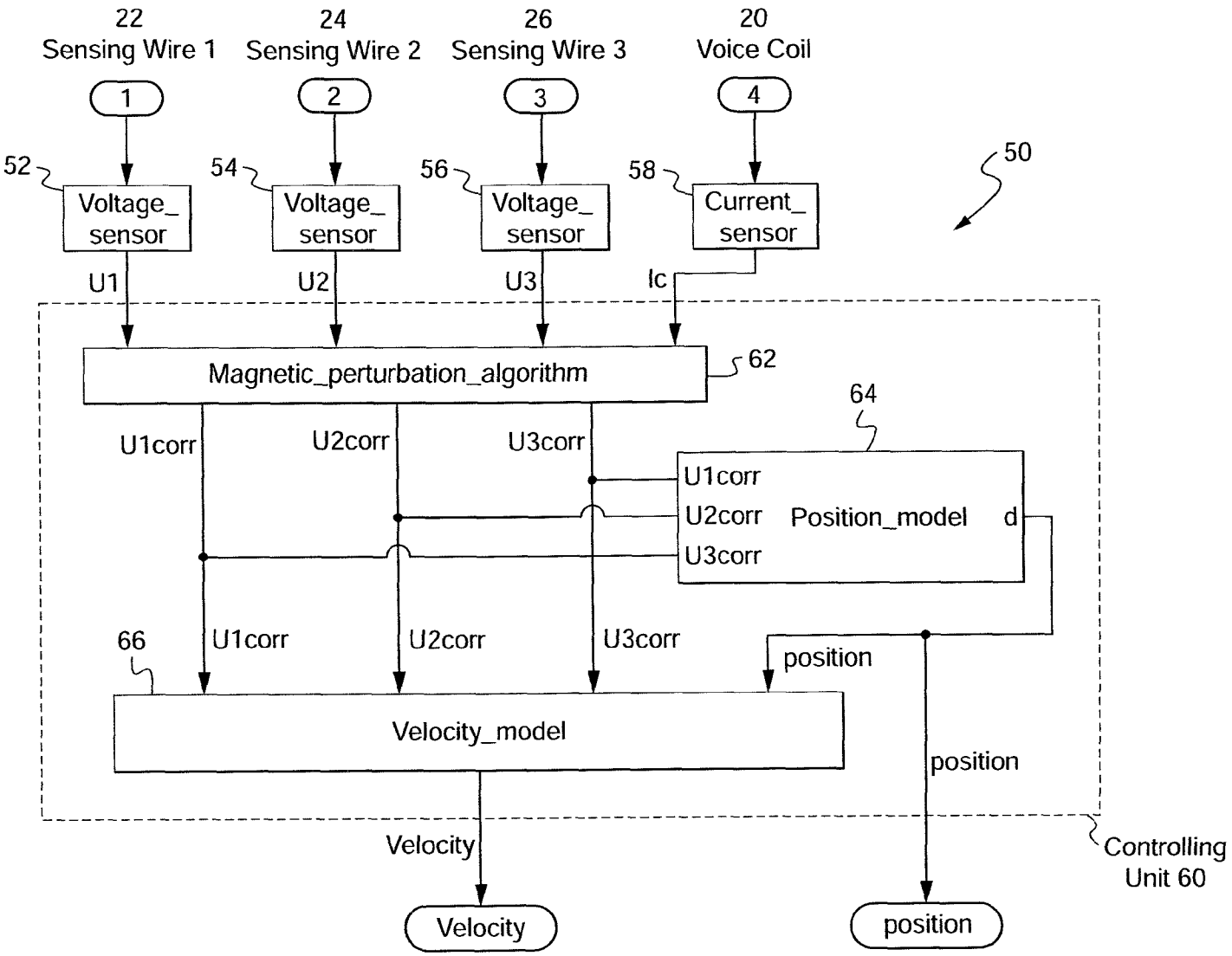
FIG. 3 is a schematic overall view of a system for determining the position and velocity of the voice-coil of FIGS. 1 and 2.

FIG. 3 is a schematic overview of a system 50 for determining the position and velocity of actuator 20.

System 50 comprises three measurement devices 52, 54 and 56 which measure each output sensing data produced by each sensing coil 22, 24 and 26.

In particular, these devices 52, 54 and 56 respectively measure the value of the voltage produced between the wire ends of sensing coils 22, 24 and 26 and output respective values U1, U2 and U3.

System 50 also comprises another measurement device 58 which measures the electrical current through voice-coil 20.

In particular, device 58 is a current sensor connected to voice-coil 20 and which outputs the value Ic.

System 50 further comprises a controlling unit or digital signal processor 60.

In order to reduce the costs, the already existing controlling unit that is in charge of the loudspeaker driver equalization and the other existing signal processing functions of the loudspeaker driver is used for implementing the present invention.

It is to be noted that the implementation of the invention through controlling unit 60 does not necessitate high signal processing computation power.

By way of example, implementation of the invention necessitates four analog inputs to controlling unit 60 as well as an additional classical low-voltage, low-current signal amplification.

As schematically illustrated in FIG. 3, controlling unit 60 comprises an optional magnetic perturbation module 62, a position determination module 64 and a velocity determination module 66.

Module 62 outputs values U1corr, U2corr and U3corr which are then supplied both to module 64 and module 66.

Module 64 next outputs the axial position d which is supplied to module 66.

The latter then outputs velocity of the loudspeaker driver actuator.

The functioning of these modules will be described in the remainder of the description.

As already mentioned above, the determination of the actuator 20 position or sensing of its position is based on the use of a fraction of the overall voltage of each sensing coil rather than the overall sensing coil voltage itself.

In the present embodiment, the fraction or ratio $Ui/U_{tot}$ is used where Ui is the value of the voltage provided by the sensing coil i (sensing coil i being one of sensing coils 22, 24 and 26) and $U_{tot}$ represents the sum of all the sensing voltages U1, U2 and U3 produced by all the sensing coils 22, 24 and 26.

Figure 4:
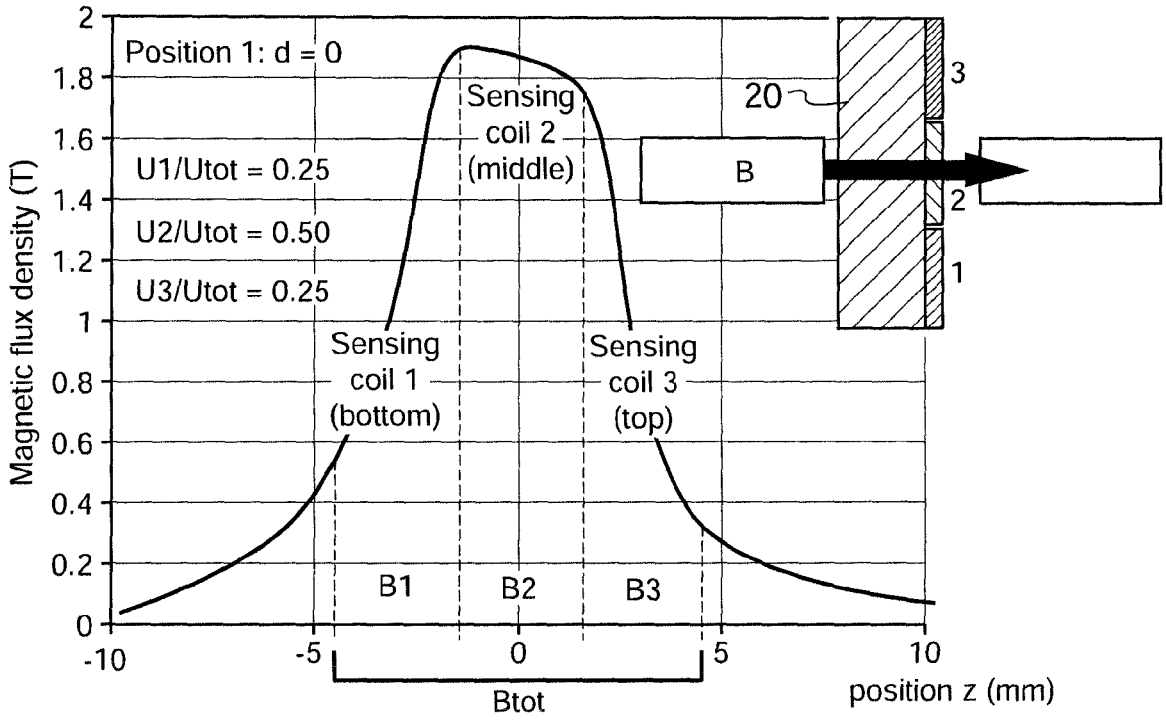
FIGS. 4, 5 and 6 represent the magnetic flux density as a function of the axial position z for three different positions of the actuator.
Figure 5:
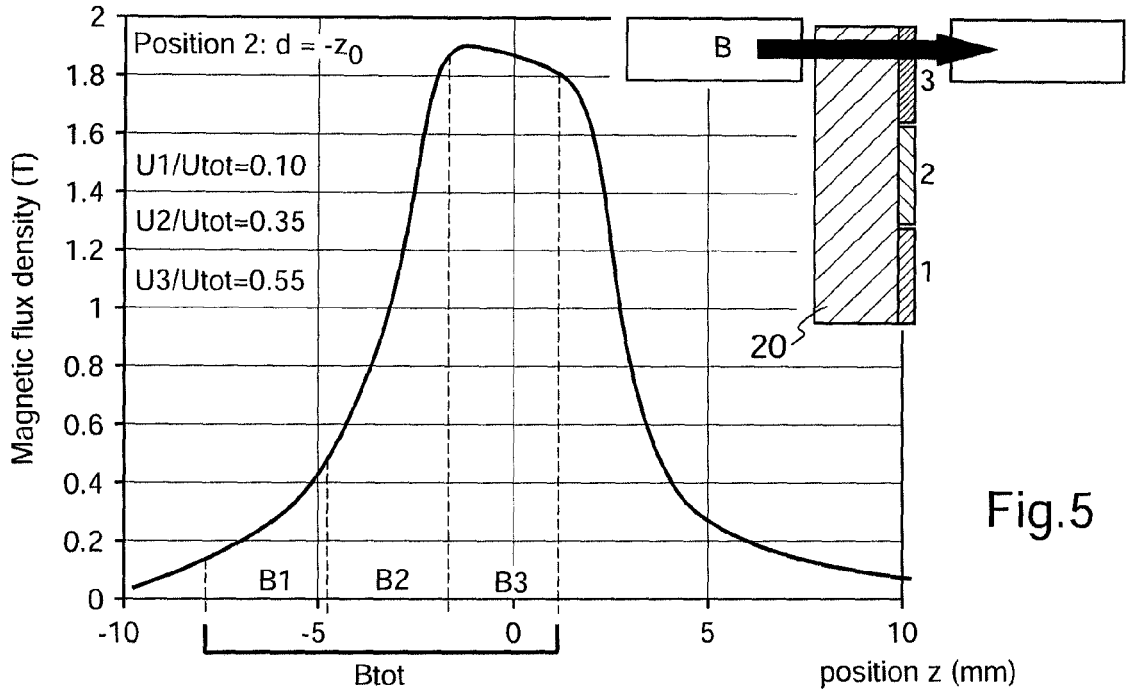
Figure 6:
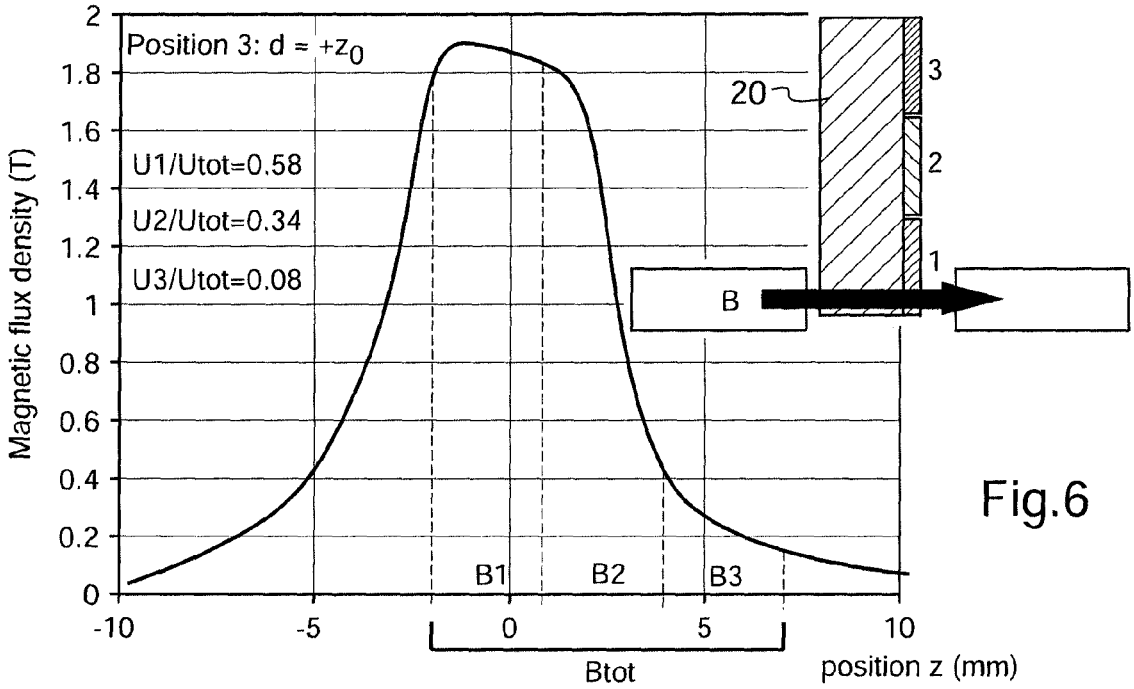

FIGS. 4, 5 and 6 respectively illustrate three different axial positions of voice-coil 20.

In FIG. 4, voice-coil 20 is in a median position defined by the axial position d=0. The position of voice-coil 20 with respect to magnetic gap G and their associated dimensions are only schematic and given by way of mere illustration.

The graph illustrated in FIG. 4 represents the magnetic flux density in Tesla as a function of the axial position z in mm.

As illustrated, the values B1, B2 and B3 represent each a fraction of the overall magnetic field value to which each sensing coil is subject to.

Thus, in the first position (median position), sensing coils 22, 24 and 26 are respectively subject to the following magnetic field values:

B1=25% $B_{tot}$,
B2=50% $B_{tot}$,
B3=25% $B_{tot}$.

It ensues that the ratios of interest $Ui/U_{tot}$ take the following values:

$U1/U_{tot}$=0.25,
$U2/U_{tot}$=0.50,
$U3/U_{tot}$=0.25.

FIG. 5 represents the magnetic flux density as a function of axial position z. The illustrated magnetic flux density is for a lower position of voice-coil 20 obtained by displacing the voice-coil downwardly to an axial position d=$-z_0$. The position of voice-coil 20 with respect to magnetic gap G and their associated dimensions are only schematic and given by way of mere illustration.

The respective ratios $Ui/U_{tot}$ therefore take the following values:

$U1/U_{tot}$=0.10,
$U2/U_{tot}$=0.35,
$U3/U_{tot}$=0.55.

FIG. 5 also represents the respective values of the magnetic field B1, B2 and B3 to which each sensing coil is subject to in this new position.

FIG. 6 represents the magnetic flux density as a function of axial position z. The illustrated magnetic flux density is for an upper position of voice-coil 20 obtained by displacing the voice-coil upwardly to an axial position d=$+z_0$. The position of voice-coil with respect to magnetic gap G and their associated dimensions are only schematic and given by way of mere illustration.

In this new position of the voice-coil defined by $+z_0$ the respective ratios $Ui/U_{tot}$ take the following values:

$U1/U_{tot}$=0.58,
$U2/U_{tot}$=0.34,
$U3/U_{tot}$=0.08.

The respective values of the magnetic field B1, B2 and B3 to which each sensing coil is subject to are also represented on the graph.

Figure 7:
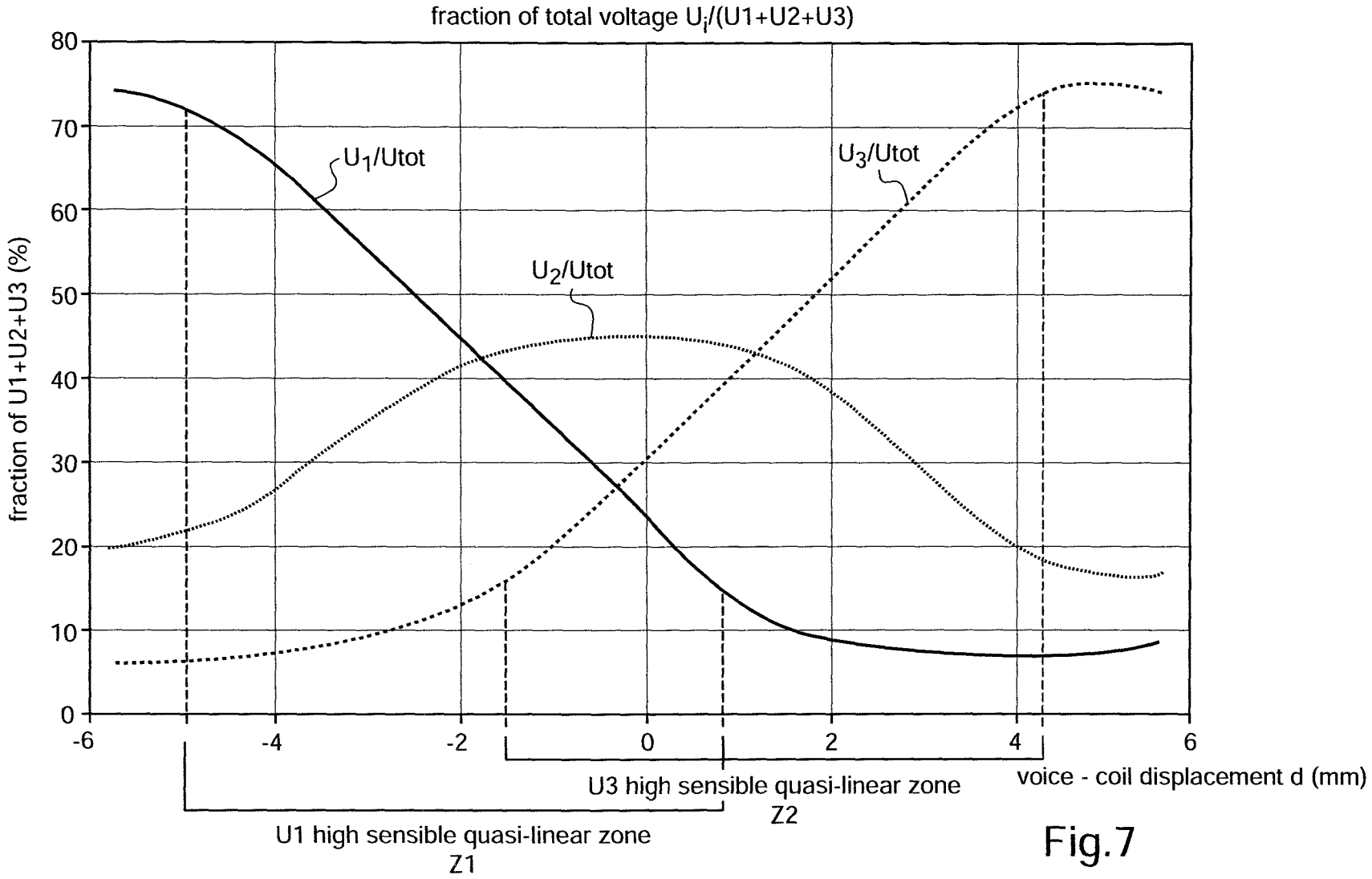
FIG. 7 illustrates different ratios $U_1/U_{tot}$, $U_2/U_{tot}$ and $U_3/U_{tot}$ as a function of actuator position d (voice-coil displacement)

FIG. 7 illustrates on the same graph the different ratios $U1/U_{tot}$, $U2/U_{tot}$ and $U3/U_{tot}$ as a function of voice-coil displacement d.

The superimposition of these different curves highlights a first zone Z1 in which ratio $U1/U_{tot}$ varies as a function of d in a substantially linear fashion and a second zone Z2 in which ratio $U3/U_{tot}$ also varies as a function of d in a substantially linear fashion. It is to be noted that these two zones have an overlapping common portion.

Use of these two ratios makes it possible to determine the position of voice-coil 20 over the whole range of voice-coil positions that is covered by both zones Z1 and Z2.

The voice-coil position is determined based on $U1/U_{tot}$ or $U3/U_{tot}$ depending on the value of the displacement/position.

It is to be noted that the information provided by the values of the ratios U1/Utot and U2/Utot and their possible respective directions of variation may be used to select the ratio which is the most appropriate for determining the voice-coil position.

Due to the induction effect, each sensing coil 22, 24, 26 exhibits the following voltage:

$$U_i=(B_r)_i(d)=L_i\cdot v_{coil}$$

Where $(B_r)_i(d)$ is the average value of the radial magnetic field the sensing coil i is subject to, as a function of the displacement d of the coil.

$U_{tot}$ has already been defined as the sum of all the sensing voltages and writes as follows:

$$U_{tot}=\sum_i U_i.$$

Thus, it ensues that:

$$\frac{U_i}{U_{tot}}=\frac{U_i}{\sum_i U_i}=\frac{\langle B_r\rangle_i(d)}{\langle B_r\rangle_{tot}(d)}\cdot\frac{L_i}{\sum_i L_i}$$

where $(B_r)_{tot}(d)$ is the average overall radial magnetic field value. It represents the average of the magnetic field weighted by the lengths of the sensing coils and can be expressed as follows:

$$\frac{\sum_i L_i(B_r)_i}{\sum_i L_i}.$$

In the present embodiment, in which all the sensing coils have each the same length L0/3, the different magnetic field values to which each sensing coil is subject to are given by the following formulas:

$$(B_r)_1(d) = \int_{-\frac{h_{voice_{coil}}}{6}+d}^{\frac{h_{voice_{coil}}}{2}+d} \frac{Br(z)dz}{\frac{L_0}{3}}$$

$$(B_r)_2(d) = \int_{-\frac{h_{voice_{coil}}}{6}+d}^{\frac{h_{voice_{coil}}}{6}+d} \frac{Br(z)dz}{\frac{L_0}{3}}$$

$$(B_r)_3(d) = \int_{-\frac{h_{voice_{coil}}}{2}+d}^{-\frac{h_{voice_{coil}}}{6}+d} \frac{Br(z)dz}{\frac{L_0}{3}}$$

$$(B_r)_{tot}(d) = \frac{\sum_i (B_r)_i(d)}{3}$$

where $B_r(z)$ is the radial magnetic field value as a function of the z axial coordinate or position, and $h_{voice_{coil}}$ is the height of the voice coil.

It is to be noted that the above formulas also apply to sensing coils with different wire lengths L1, L2, L3. In this case, the term L0/3 has to be replaced in each formula by L1, L2 and L3 accordingly.

It follows from the above that $$\frac{U_i}{U_{tot}}$$

depends only on the displacement d of the voice-coil, via the Br(z) function and the sensing coils lengths. $B_r(z)$ depends only on the loudspeaker driver motor design and is a very stable constant. It can be obtained by measurements or by simulation of the loudspeaker driver.

Consequently, the ratio $Ui/U_{tot}$ depends on d only. Indeed, we have:

$$\frac{U_i}{U_{tot}} = M_i(d),$$

from which the position d can be drawn as follows:

$$d = M_i^{-1}\left(\frac{U_i}{U_{tot}}\right)$$

where $M_i^{-1}$ is the inverse function of Mi, and $$M_i = \frac{\langle B_r\rangle_i(d)}{\langle B_r\rangle_{tot}(d)} \cdot \frac{L_i}{\Sigma_i L_i}.$$

Thus, the position d is derived from the appropriate ratio $Ui/U_{tot}$ via the $M_i^{-1}$ function (i being an index corresponding to one of the sensing coils).

Practically, it is not necessary to analytically determine the $M_i^{-1}$ function in order to derive d therefrom since this operation may prove to be difficult.

In one embodiment, the $M_i^{-1}$ function is obtained through measurements using a displacement sensor and a voltage measurement apparatus.

This can be done prior to using the loudspeaker driver, for example at the manufacturing stage.

According to the embodiment, the loudspeaker driver is supplied with a given input signal which induces various values of $Ui/U_{tot}$ and positions d.

The plurality of couples of values $(d, Ui/U_{tot})$ are solutions of the function Mi and are recorded by the displacement sensor and the voltage measurement apparatus.

According to the embodiment, the recorded couples of values are stored in a memory of controlling unit 60 (such a memory is not represented in the drawing for the sake of clarity).

The above operations are performed for a given sensing coil that is preferably chosen to be an overlapping sensing coil such as the upper sensing coil 26 or the lower sensing coil 22. For the upper sensing coil 26, couples of values $(d, U3/U_{tot})$ are determined. For the lower sensing coil 22, couples of values $(d, U1/U_{tot})$ are determined.

As will be described later, several sensing coils can be used for sensing the displacement of the voice-coil according to an embodiment of the invention. In this case, the above operations are repeated for each sensing coil used. For the embodiment illustrated in FIG. 9*a* for example, the above operations are performed for both lower and upper sensing coils.

These stored values form a lookup table enabling retrieval of a given position d for a given value of $Ui/U_{tot}$.

The retrieved position thus corresponds to $M_i^{-1}(Ui/U_{tot})$.

Retrieving a position from the lookup table can be done after interpolating different elements in the lookup table to have a better accuracy in sensing the displacement given a limited number of measured/recorded couples $(d, Ui/U_{tot})$.

According to a variant embodiment, the recorded couples of values are used to determine the parameters of a best-fit polynomial function.

These parameters are stored within a memory of controlling unit 60 and may be used subsequently for deriving the voice-coil position therefrom. This reduces the quantity of information to be stored. The reduction of the quantity of information is particularly significant when the function Mi is linear.

According to another embodiment, the $M_i^{-1}$ function is obtained thanks to the Br(z) function and not through position and voltage measurements.

The Br(z) function may be obtained through measurements (using a magnetic field or a flux sensor) or by simulation of the loudspeaker driver.

Once the Br(z) function has been determined, it is quite constant and stable.

It is to be noted that the position d of the voice-coil is related through the function $M_i$ to the following ratio corresponding to $Ui/U_{tot}$:

$$\left(\frac{\langle B_r\rangle_i(d)}{\langle B_r\rangle_{tot}(d)} \cdot \frac{L_i}{\Sigma_i L_i}\right)$$

It is to be noted that any variation in the Br(z) function, e.g. due to aging, affects both terms $\langle Br\rangle i(d)$ and $\langle Br\rangle_{tot}(d)$ with the same magnitude. Therefore, such a variation does not affect the accuracy of the determined or sensed position d.

The average value of the radial magnetic field $\langle Br\rangle i$ the sensing coil corresponding to index i is subject to and the average overall radial magnetic field value $\langle Br\rangle_{tot}$ are determined for a plurality of positions d of the voice-coil. Corresponding values of the function Mi are then determined by calculation, resulting into a plurality of determined couples of values (d, $Ui/U_{tot}$) that are stored. These stored couples form a lookup table enabling retrieval of a displacement d for a given ratio $Ui/U_{tot}$ of measured voltages, according to one of the methods described above (lookup table, interpolation, best-fit polynomial).

The above calculation for determining the couples of values is repeated preferably for each sensing coil corresponding to index i to be used for sensing the displacement of the voice-coil.

FIGS. 5 and 6 show how different axial positions of voice-coil 20 can be characterised/determined by different sets of $Ui/U_{tot}$ ratio parameters.

Each set is unique and sufficient to determine the voice-coil position.

Figure 8:
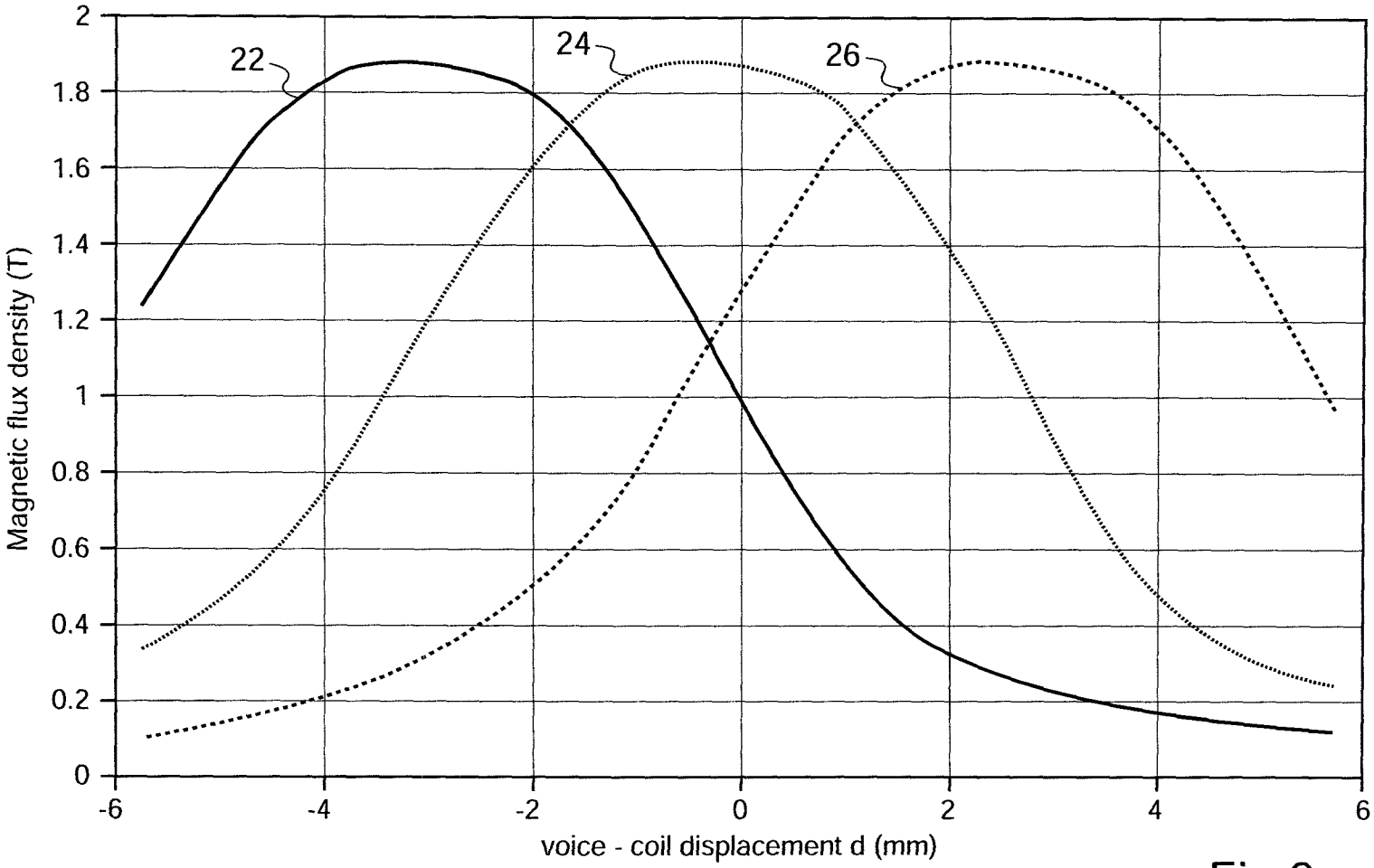
FIG. 8 illustrates the average magnetic flux density across each sensing member as a function of actuator position d (voice-coil displacement)

Simulations of $Ui/U_{tot}$ as a function of the voice-coil position (FIGS. 7 and 9*b*), the average magnetic flux density across each sensing coil as a function of voice-coil position (FIG. 8) and voice-coil position as a function of $Ui/U_{tot}$ (FIG. 9*a*), $(Ui-Uj)/U_{tot}$ (FIG. 9*c*) and (Ui−Uj)/(Ui+Uj) (FIG. 9*d*) have been made based on the following loudspeaker driver parameters:

| | |
|---|---|
| Voice coil height: | 8.5 mm |
| Motor upper plate thickness: | 4.5 mm |
| Voice coil number of spires: | 52 spires |
| Force factor BI: | 6 Tm |
| Gap maximum magnetic field value: | 1.6 T |
| The sensing coils characteristics are: | |
| Total height = Voice coil length = | 8.5 mm |
| Ni = | 67 spires |
| Li = | 5 m |

The following functions $M_i^{-1}$ have been calculated and implemented in the software of the loudspeaker driver defined by the above parameters.

Figure 9A:
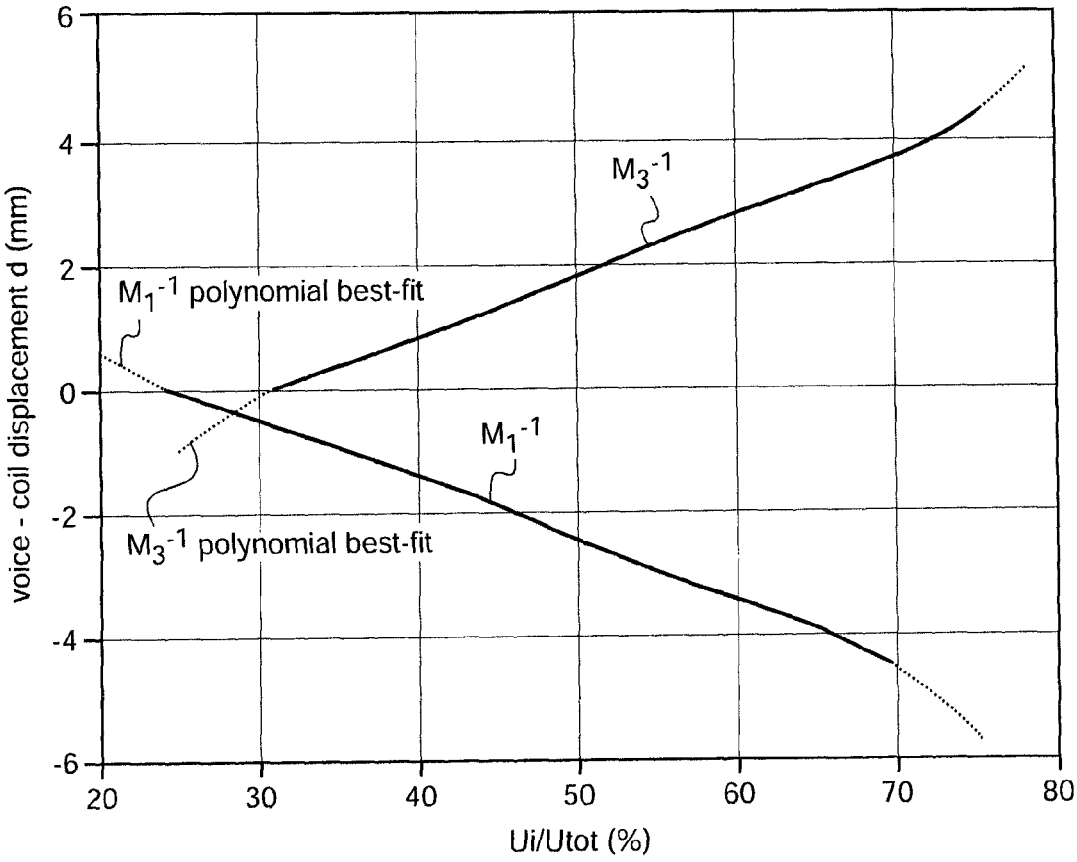
FIG. 9*a* illustrates the actuator position as a function of $Ui/U_{tot}$.

The $M_i^{-1}$ functions illustrated in FIG. 9*a* have been used with the following formulas:

$$\begin{cases} d = M_1^{-1}\left(\frac{U_1}{U_{tot}}\right) & \forall\ \frac{U_1}{U_{tot}} \geq 30.8\% \\ d = M_3^{-1}\left(\frac{U_3}{U_{tot}}\right) & \forall\ \frac{U_3}{U_{tot}} > 24.2\% \end{cases}$$

These formulas make it possible to cover the whole displacement range or range of positions of the voice-coil (this range lies from −4.5 mm to +4.5 mm).

This is an highly extended range since the voice-coil nominal displacement is defined by +/−2 mm.

It is to be noted that, theoretically, each of the three sensing coils 22, 24, 26 could lead to the value of the voice-coil position.

However, when looking at FIG. 7 it appears that each single curve $Ui/U_{tot}$ has a small high-slope (high accuracy) interesting portion and two wide low-slope (small accuracy) portions. Sensing/determining the voice-coil position with these wide low-slope portions would lead to poor accuracy. However combining high-slope portions of the different curves leads to a high accuracy in a highly extended range of voice-coil displacements.

In the present embodiment, $U1/U_{tot}$ and $U3/U_{tot}$ exhibit each a high-slope linear behaviour as a function of displacement or position d in different complementary portions of position ranges (or sub-ranges).

This means that a good accuracy can be obtained over a wide range of positions if suitable signal processing is used.

The present embodiment therefore provides a linear, high sensitivity sensing solution.

Thus, as illustrated in FIG. 9*a*, position d of the voice-coil is obtained through ratio $U1/U_{tot}$ for negative positions and ratio $U3/U_{tot}$ for positive positions.

Figure 9B:
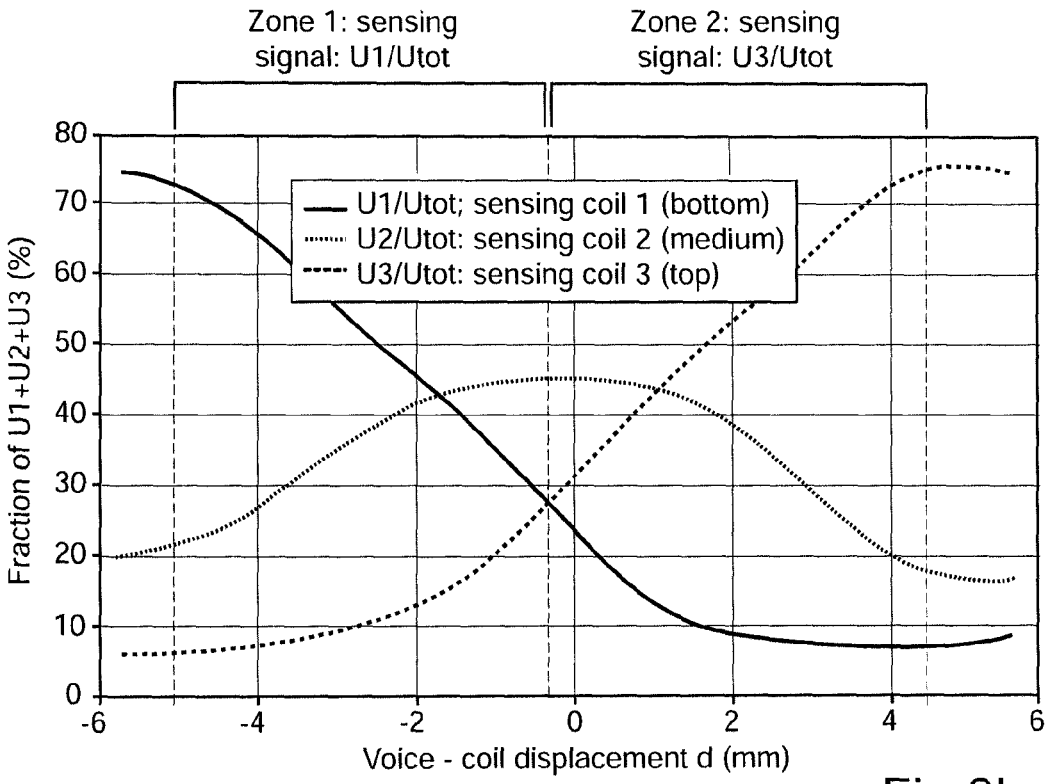
FIG. 9*b* illustrates the different ratios $U_1/U_{tot}$, $U_2/U_{tot}$ and $U_3/U_{tot}$ as a function of the voice-coil position with an indication of the zones in which sensing signals $U_1/U_{tot}$ and $U_3/U_{tot}$ are used.

FIG. 9*b* illustrates simulations of $Ui/U_{tot}$ as a function of the voice-coil position similarly to FIG. 7 with an added indication of the zones 1 and 2 in which sensing signals $U1/U_{tot}$ and $U3/U_{tot}$ are respectively used.

Module 64 in FIG. 3 provides position d of voice-coil 20 based on the above formulas, depending on the values of $Ui/U_{tot}$.

Figure 9C:
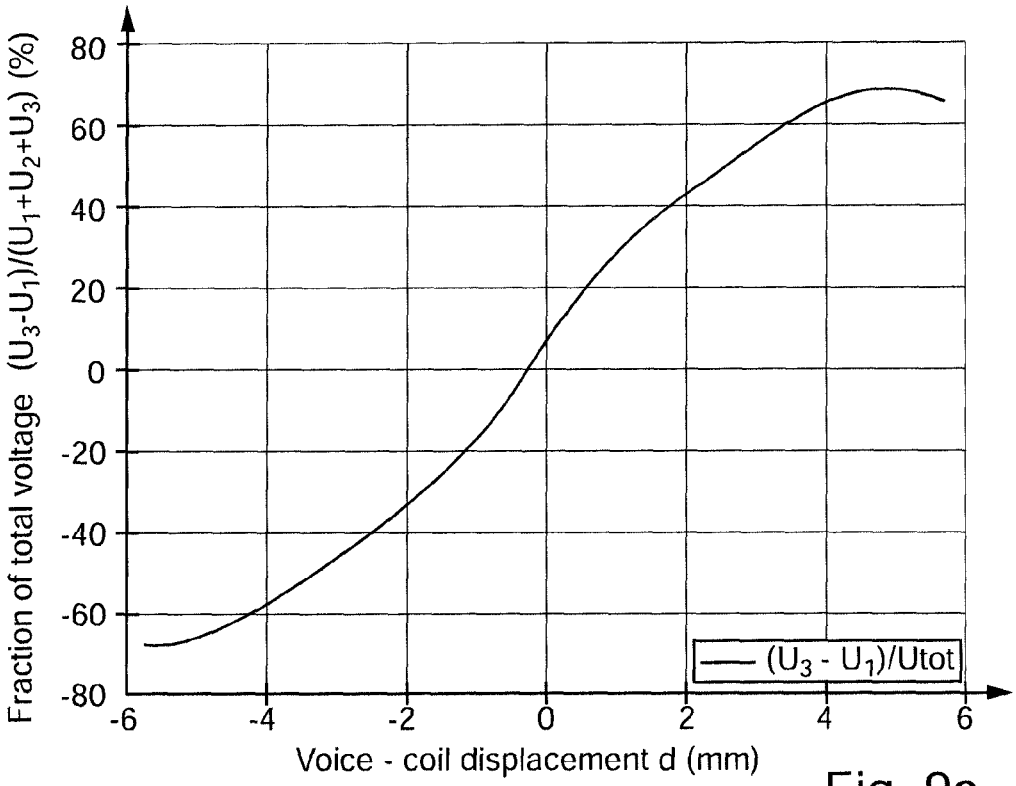
FIGS. 9*c* and 9*d* respectively illustrate the ratios $(Ui-Uj)/U_{tot}$ and (Ui−Uj)/(Ui+Uj) as a function of the actuator position d.

According to another embodiment, a function $(Ui-Uj)/U_{tot}$=M'ij(d) is used for sensing the displacement d. FIG. 9*c* shows the curve $(U3-U1)/U_{tot}$ as a function of the displacement d (thus corresponding to function $M'_{31}$). As it can be seen, this function has a high slope in the range [−4 mm, +4 mm] which gives the advantage that a single function ($M'_{31}$) can be used for determining position d of the voice-coil for both negative and positive positions and for an extended range of voice-coil displacements. It should be noted that the slope of this function is higher compared to $U1/U_{tot}$ or $U3/U_{tot}$ which leads then to a higher accuracy. Indeed, we observe a variation of about 60% (from 5 to 65%) of the ratio $(U3-U1)/U_{tot}$ for d varying from 0 to +4 mm, whereas the variation of $U3/U_{tot}$ is lower as it is about 45% (from 30 to 75%) for the same variation of d.

The lookup table for the function M'ij(d) can be easily formed from the couple of values of (d, $Ui/U_{tot}$) and (d, $Uj/U_{tot}$), each being obtained according to the methods described above. It can also be constructed from the measurements of d and of each Ui or by calculation from Br(z) as detailed above.

Figure 9D:
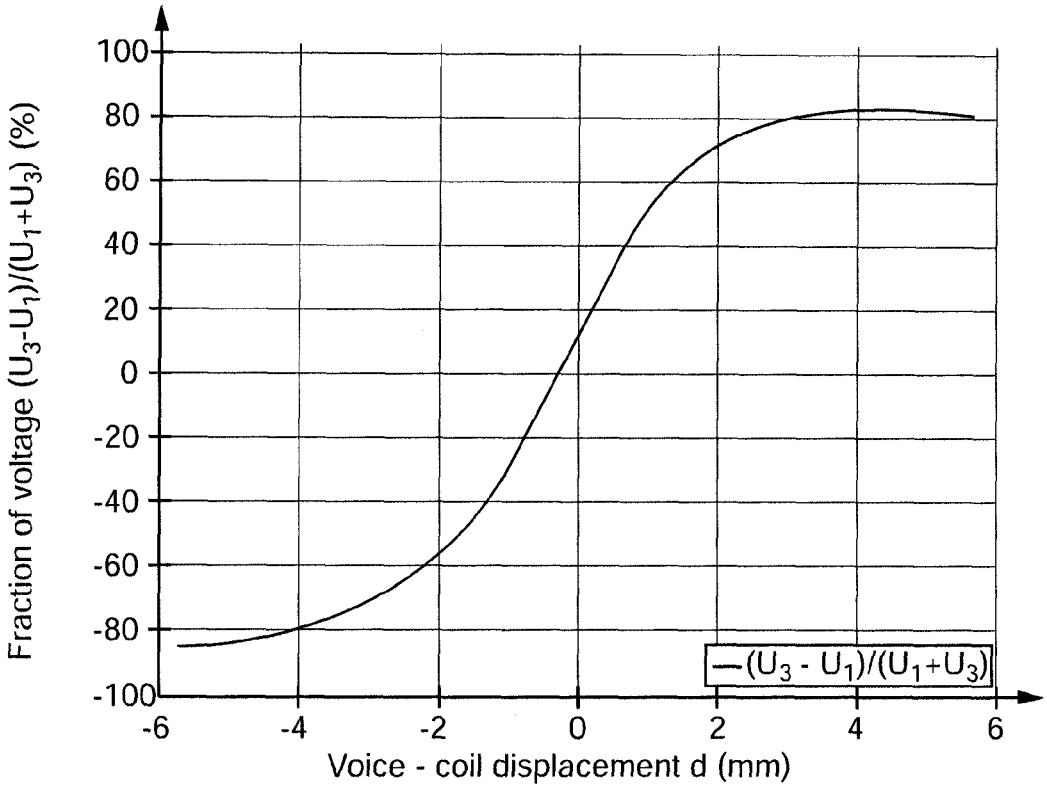

According to yet another embodiment, a function (Ui−Uj)/(Ui+Uj)=M"ij(d) is used for sensing the displacement d. FIG. 9*d* shows the curve (U3−U1)/(U3+U1) as a function of the displacement d (thus corresponding to function $M''_{31}$). As it can be seen, this function is linear with a very high-slope in the range [−1 mm, +1 mm]. Indeed, we observe a variation of about 80% (from −30% to 50%) for d varying from −1 mm to +1 mm. Consequently, this function is preferred for sensing low range displacements (+/−1 mm) with a very high accuracy.

Also, the function being linear, only two parameters corresponding to the slope and a constant offset of the function can be stored within the memory of controlling unit 60. This leads to a significant reduction in the quantity of information stored and to a fast retrieval of a sensed displacement d because no interpolation is needed.

Sensing/determining the velocity of voice-coil 20 is based on using $U_{tot}$ as the main sensing input.

The accuracy in the determination of the voice-coil velocity is increased by using the voice-coil position d information as it is provided by position module 64. However any alternative means for determining the position information can still be used.

The velocity of the voice-coil is determined based on the following formulas:

$$U_{tot} = \langle B_r \rangle_{tot}(d) * L_0 * v_{coil}$$

-continued $$v_{coil} = \frac{U_{tot}}{\langle B_r \rangle_{tot}(d) * L_0}$$

Where $\langle B_r \rangle_{tot}(d)$ depends only on the d position, through the constant Br(z) function.

It follows from these equations that the velocity $v_{coil}$ depends on d and $U_{tot}$ only:

$$v_{coil} = N(U_{tot} \cdot d)$$

$$N = \frac{U_{tot}}{(B_r)_{tot}(d) * L_0}$$

Where $U_{tot}$ is obtained from the sensing coils and d is obtained from the position sensing/determination.

According to one embodiment, the N function is obtained by measurements using a velocity sensor (prior to using the loudspeaker driver e.g. at the manufacturing stage) and a voltage measurement apparatus. The necessary displacement or position information is provided by the displacement or position sensing/determining means of the invention (through the $M_i^{-1}$ function).

For example, the loudspeaker driver is supplied with a given input signal which induces various $U_{tot}$, velocity $v_{coil}$ and displacement/position d values. These sets of triple values ($v_{coil}$, d, $U_{tot}$), which are solutions to the function N, are recorded by the velocity and voltage measurement apparatuses.

According to the embodiment, the recorded values are stored in a memory of controlling unit 60, and form a lookup table which will be used for retrieving a given velocity $v_{coil}$ for a given couple of values (d, $U_{tot}$) (the retrieved velocity thus corresponding to N($U_{tot}$, d)).

Retrieving a velocity from the lookup table can be done after interpolating the different elements in the table.

According to a variant embodiment, the recorded values are used to determine the parameters of a best-fit polynomial function. These parameters are stored in a memory of the controlling unit 60 and can be used subsequently for deriving the velocity therefrom.

According to another embodiment, the N function is obtained thanks to the Br(z) function. The Br(z) function can be obtained by measurements (using a magnetic field or flux sensor) or by simulation of the loudspeaker driver.

In a variant embodiment, the Br(z) measurements are stored in memory and are used for both the displacement/position determination (Mi function) and the velocity determination (N function). Thus, only the Br(z) has to be determined and calibrated at an earlier stage, for example at manufacturing.

The N function is obtained thanks to the known, constant, Br(z) function. Practically, N can be used in a software, either as a lookup table, or as a best-fit polynomial function derived from Br(z).

More particularly, the N function may be determined as follows. The average overall radial magnetic field value $\langle Br \rangle_{tot}(d)$ is determined by calculation for a plurality of positions d of the voice-coil. This leads to a plurality of couples of values (d, $\langle Br \rangle_{tot}(d)$).

Several values of $U_{tot}$ may be taken for each position d of the plurality of positions of the voice-coil taken for calculating $\langle Br \rangle_{tot}(d)$, thereby leading to several values of the velocity $v_{coil}$ calculated by means of the N function for the several values of $\langle Br \rangle_{tot}(d)$ and $U_{tot}$.

Thus, a plurality of triplets of values ($v_{coil}$, $U_{tot}$, d) are obtained and stored. These stored triplets form a lookup table enabling retrieval of a voice-coil velocity $v_{coil}$ for a given value of position d and a given value of $U_{tot}$, according to one of the methods described above (lookup table, interpolation, best-fit polynomial).

Figure 10:
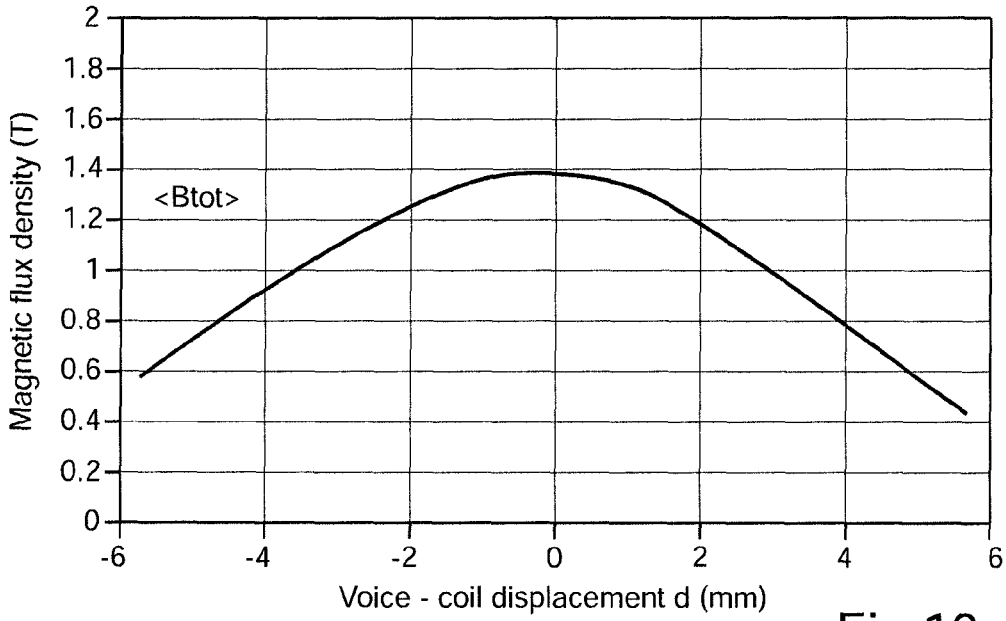
FIG. 10 illustrates the average magnetic flux density across the actuator.

Velocity sensing simulations have been performed with the above-mentioned loudspeaker driver parameters. The corresponding $(B_r)_{tot}(d)$ function to be used in the N function for sensing/determining the voice-coil velocity sensing is illustrated in FIG. 10.

Figure 11:
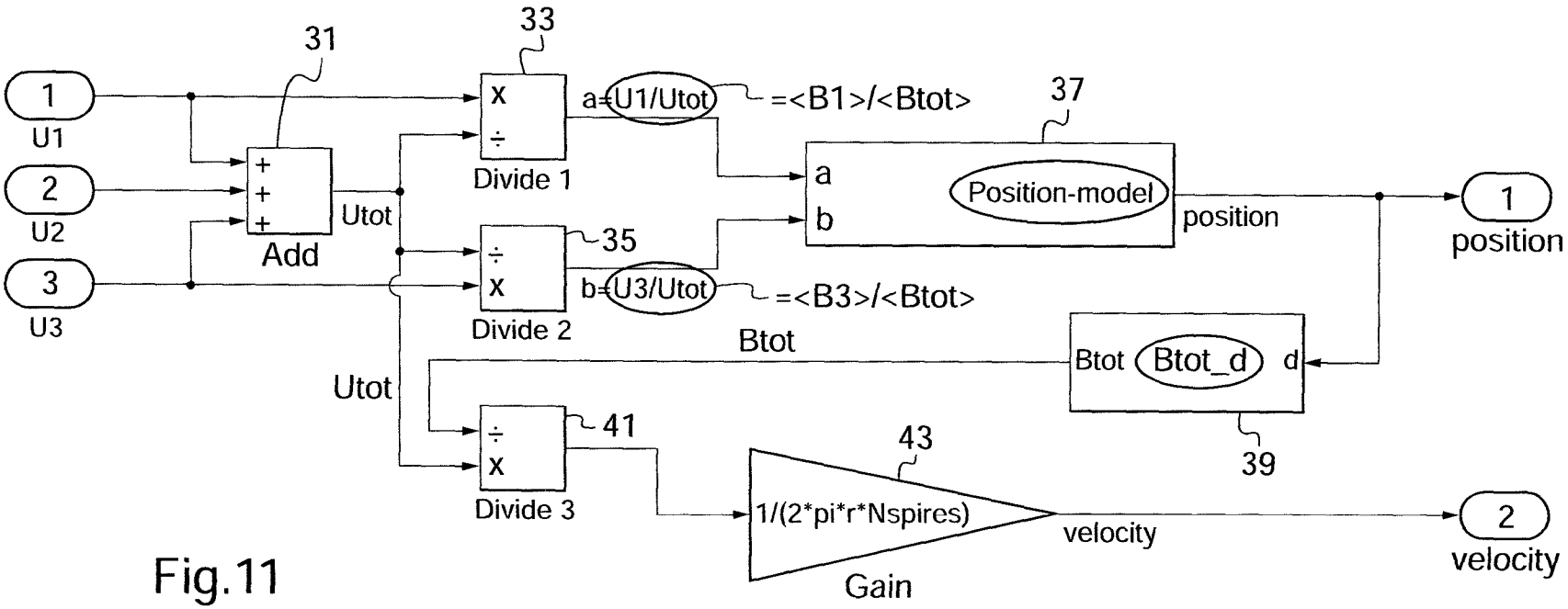
FIG. 11 schematically illustrates the different functions carried out in order to sense/determine the position and velocity of an actuator in a loudspeaker driver.

FIG. 11 schematically illustrates the different functions carried out by an algorithm or several algorithms implemented in modules 64 and 66 of FIG. 3 with a view to sensing/determining the position and velocity of voice-coil 20 respectively.

FIG. 11 schematically represents several functional blocks or modules performing the different functions implemented when the algorithm or algorithms are executed by modules 64 and 66 of FIG. 3.

A first functional block 31 calculates the sum of all the output sensing data provided by sensing members or sensing coils 22, 24 and 26.

More particularly, the sum of all these data U1, U2 and U3 is denoted $U_{tot}$.

Next, two separate functional blocks or modules 33 and 35 calculate the ratios $U_1/U_{tot}$ and $U_3/U_{tot}$ respectively.

These ratios are then transmitted to a functional block or module 37 which performs the function of determining the position of voice-coil 20 based on the above-cited ratios.

More particularly, block 37 determines the voice-coil position based on the graphical functions $M_1^{-1}$ and $M_3^{-1}$ illustrated in FIG. 9*a*.

Knowledge of the voice-coil position d is used for determining the average overall radial magnetic field value through the constant Br(z) function by the functional block or module 39.

Different methods have been described above in order to obtain the Br(z) function.

Next, a function block or module 41 divides $U_{tot}$ by $B_{tot}$ supplied by module 39 and forwards the result to gain function block or module 43.

Module 43 applies a gain to the result of the calculation provided by module 41.

This gain corresponds to the value $1/L_0$ used in one of the above-mentioned formulas where $L_0$ is the sum of the wire length of the three sensing coils 22, 24 and 26.

Module 43 then calculates and provides the velocity of voice-coil 20.

As has already been mentioned above system 50 comprises module 62 for correcting the magnetic perturbations.

This module aims at correcting the output sensing data Ui provided by each sensing coil 22, 24, 26 to take into account the inductance factor $M_{Ci}$ between voice-coil 20 and each sensing coil.

These magnetic induction effects come from the fact that the electrical current circulating into the voice coil creates magnetic induction in the sensing coils 22, 24 and 26.

Thus, when taking into account the induced perturbation, the actual voltage across each sensing coil reads as follows:

$$\underbrace{U_i = \langle B_r \rangle_i(d) * L_i \cdot v_{coil}}_{\text{Signal to be measured}} + \underbrace{M_{C_i} \frac{dI_C}{dt}}_{\text{Induced perturbation}}$$

Where $I_C$ is the electrical current value in the voice coil, and $M_{Ci}$ is the mutual inductance between the voice coil and the sensing coil i.

The current Ic in the voice coil is then sensed/obtained in order to get the corrected input voltage which gets rid of the perturbation as follows:

$$U_{corr} = U_i - M_{C_i}\frac{dI_C}{dt}$$

Figure 12:
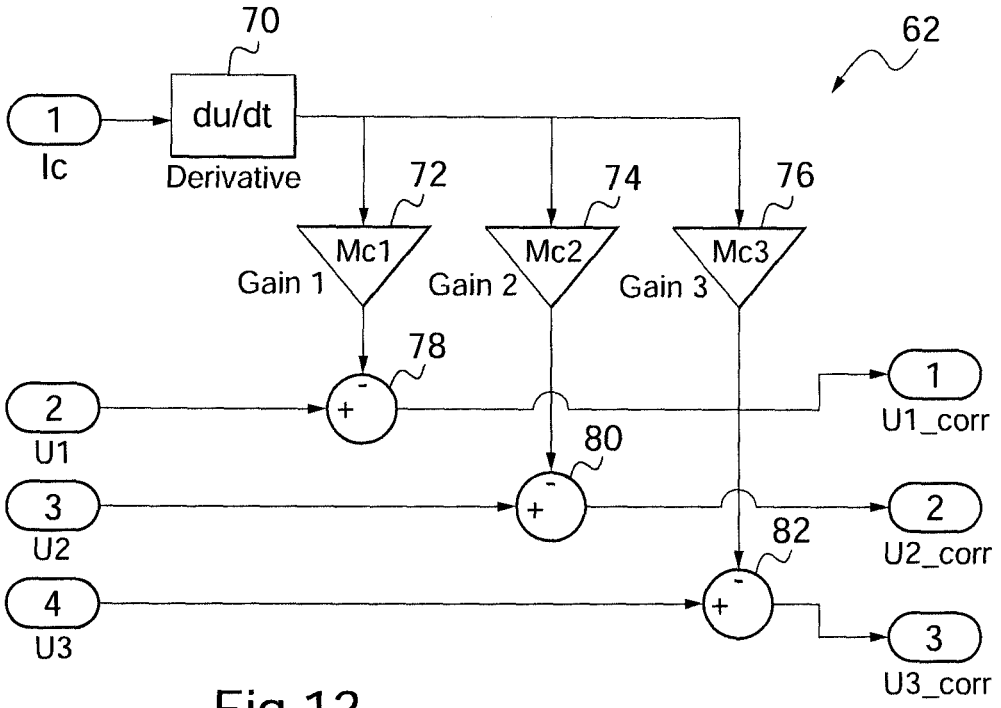
FIG. 12 schematically illustrates the different functions carried out for correcting the magnetic perturbations.

A simple, yet efficient, magnetic perturbation correction algorithm is schematically illustrated in FIG. 12.

FIG. 12 schematically illustrates the different functions carried out by an algorithm in order to correct the magnetic perturbations.

This algorithm is implemented in module 62 of FIG. 3 which comprises functional blocks or modules.

More particularly, a first functional block 70 calculates and obtains the variation of the electrical current $I_C$ in time, $dI_C/dt$, through a derivative functional block "du/dt".

Several functional blocks 72, 74 and 76 apply each a mutual inductance factor Mc1, Mc2 and Mc3 respectively to the inputted value $dI_c/dt$ that is supplied by block 70.

Each value Mci $dI_C/dt$ is then combined to output sensing data $U_i$ through a summation function 78, 80 and 82 respectively so as to provide respective values $U1_{corr}$, $U2_{corr}$, $U3_{corr}$.

These values are then sent to modules 64 and 66 of FIG. 3.

Each mutual inductance is expressed as follows:

$$M_{C_i}=\mu_0\mu_r n_C n_i \pi R_i^2 L_i$$

Where $n_C$ and $n_i$ are the density of spires (number of spires/m) of the voice coil ($n_C$) and the sensing coil i and $R_i$ is the electrical resistance of the wire.

This shows that the perturbation coefficient $M_{Ci}$ is constant and stable, depending only on constant physical parameters related to the design.

The only parameter which can vary slightly with the temperature of the coil is the wire resistance $R_i$. However, $R_i$ is very easy to measure if necessary.

The correction parameters Mci can be automatically obtained through a simple algorithm procedure.

In order to have an even more flexible and accurate correction means, the correcting parameters Mci may be obtained in real-time if needed through using an auto-calibration procedure.

This procedure is based on the following formula:

$$M_{C_i} \cong \frac{|U_i|}{\omega|I_C|} \forall\, \omega \gg \omega_{resonance}$$

when the voice coil is supplied with a sinusoidal signal Ic(ω), where ω is the angular frequency equal to 2*pi*frequency of the signal Ic and $\omega_{resonance}$ is the main mechanical resonance angular frequency of the loudspeaker driver.

This procedure originates from the frequency response behaviour of the voice coil: when $\omega \gg \omega_{resonance}$, the voice coil movement is negligible, which means that the sensing coil response mainly comes from the magnetic perturbations. This property enables execution of the following real-time auto-calibration procedure:

A signal is generated at a frequency well above the maximum frequency humans can hear. It can be added to the normal audio signal the loudspeaker driver has to reproduce, which means that the procedure can be done in real-time during the normal use of the loudspeaker driver.

The signal frequency being far above the resonance frequency of the loudspeaker driver, there is only a negligible movement of the voice-coil. Hence, the sensing signal generated by the normal induction effect is negligible. However, magnetic perturbations generated at this frequency are high.

Figure 13:
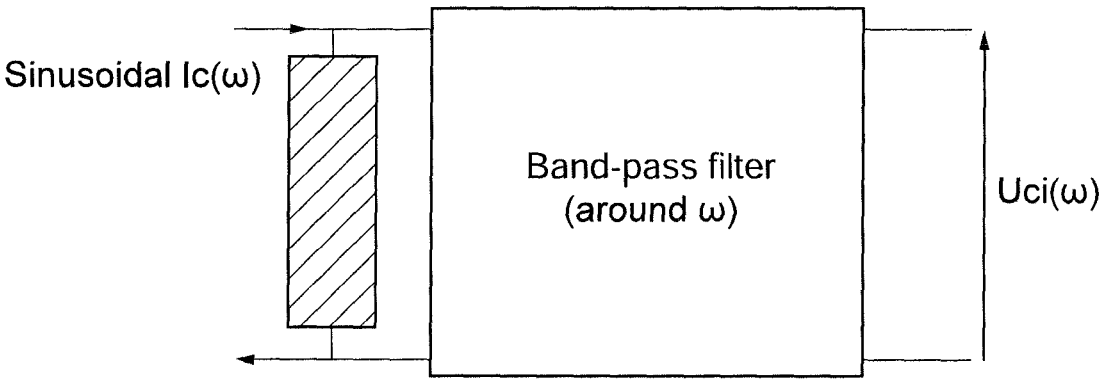
FIG. 13 schematically illustrates a narrow band-pass filter.

A narrow band-pass filter (see FIG. 13) is used (frequency of the filter around ω) and separates the generated high-perturbation signal from the rest, and provides Ui(ω). The filtering is very accurate since there is no audio signal near ω.

The normal Ui signal which is necessary to get the position and velocity sensing is extracted from the following expression: Uinormal=Ui−Ui(ω)

Mci is then obtained or updated using to the following formula:

$$M_{C_i} \cong \frac{|U_i|}{\omega|I_C(\omega)|}$$

Thanks to this accurate, automatic, easy to use magnetic perturbation correction procedure, the sensor signals (output sensing data) are protected from possible magnetic perturbations induced by the voice coil. This solves the issue of having sensing coils located near the voice coil.

The sensing device or sensor (plurality of sensing members) sensitivity depends on the number of spires of each sensing coil. The more spires, the more sensitive the sensor is. There is no actual limit on the number of spires of each sensing coil. However, manufacturing constraints set a lower limit preventing from manufacturing too thin wires which prove to be too fragile. Hence, high sensitivity values can be reached thanks to the invention.

The sensing device or sensor sensitivity has been determined by way of example with the numerical values of the loudspeaker driver and sensing coils characteristics given above.

The signal used for the displacement d sensing is $$\frac{U_i}{U_{tot}}.$$

The sensitivity can be assessed from the high-sensitivity parts of the ratios U1/Utot and U3/Utot illustrated in FIGS. 7 and 9*b* as follows:

$$\frac{\Delta\left(\frac{U_i}{U_{tot}}\right)}{\Delta d} \cong 10\%\ (U_{tot})/\text{mm} \cong 10\%\ (\langle B_r\rangle_{tot}(d) * 2\Pi r_{coil} * N_{spires} * v_{coil})/\text{mm}$$

At 100 Hz frequency, for 200 spires, the above sensitivity takes the following value $$\frac{\Delta\left(\frac{U_i}{U_{tot}}\right)}{\Delta d} \cong 2V/\text{mm}$$

which represents a high displacement sensitivity.

The signal used for the velocity sensing is $U_{tot}$. The velocity sensitivity can be assessed from the following:

$$\frac{\Delta(U_{tot})}{\Delta v_{coil}} = \langle B_r\rangle_{tot}(d) * 2\Pi r_{coil} * N_{spires} \cong \frac{20V}{\frac{m}{s}},$$

which represents a high velocity sensitivity.

The sensing wires are thin enough so that the magnetic gap dimensions and the coil weight remain essentially the same. There is no additional magnetic circuit, contrary to most prior art devices. Furthermore, there is nothing more than thin and small wires. This means that there are no or very small design changes, and no impact on the loudspeaker driver performances.

Adding several sensing members (sensing coils) to an existing loudspeaker driver represents an ultra-compact (even invisible) solution because the sensing members are completely integrated into the prior existing loudspeaker design and even hidden thereinto.

The sensing device (plurality of sensing members) can be an all-in one sensor, which provides both position and velocity of the loudspeaker driver voice-coil (and therefore the position of the membrane too).

Contrary to most prior art solutions which can provide the position and velocity at the same time by using only one basic physical source (e.g. accelerometers), the present sensing device/method does not derive the position from the velocity only or vice-versa by integration/derivation. It is therefore less error-prone than conventional indirect measurement solutions. In these prior art solutions, the uncertainties get accumulated at each step and the resulting final accuracy proves to be low.

According to the present invention, the position and velocity are obtained thanks to two different principles. It is true that the position information is used for the velocity calculation, but only in order to improve the accuracy of the calculation (due to non-linear effects depending on the position), not as the only input of the velocity sensor. This is because an approximation of the velocity can be obtained independently of the position when <Br> is considered as constant or nearly constant.

It means that the sensing device or sensor delivers independent position and velocity information, for a better accuracy.

The method which has been proposed above to determine the position as well as the velocity is model-based. All models used can be derived from the Br(z) function only (radial magnetic field in the gap as a function of z). This is a constant and very stable characteristic of the loudspeaker driver, which is simple to calibrate and can even be automatically calibrated.

This makes it an accurate and robust method, as very few assumptions are needed for the measurement. The hardware part of the sensing device or sensor only consists of thin wires, which is very cheap and easy to manufacture. The signal processing is simple, and can be done inside the already existing conventional controlling unit or digital signal processor of the loudspeaker driver. The only additional cost to consider is the voltage measurements U1, U2, U3 of each sensing-coil, and the current measurement Ic of the voice coil. All the signals needed are conventional low-voltage, low-current signals. All electronic functions are well-known and easily added on the existing controller unit card of the bass loudspeaker driver.

This sensing device or sensor is therefore very cheap.

The invention claimed is:

1. A loudspeaker driver comprising:

at least one actuator connected to a vibrating support to impart excitation to the latter when caused to move, wherein the loudspeaker driver further comprises:

a plurality of sensing members arranged to move with the at least one actuator, each sensing member providing output sensing data dependent on the velocity of said at least one actuator, and means for determining the position of the at least one actuator based on at least one ratio X/Y of output sensing data or of linear combinations of output sensing data provided from the plurality of sensing members, said at least one ratio being independent of the velocity of the at least one actuator.

2. The loudspeaker driver of claim 1, wherein the position of the at least one actuator within the whole range of actuator positions is based on at least two ratios of sensing members output sensing data, each ratio covering a portion of the whole range of actuator positions.

3. The loudspeaker driver of claim 2, wherein the given sensing member is selected according to a predetermined criterion.

4. The loudspeaker driver of claim 3, wherein the selected sensing member is the sensing member for which the ratio X/Y is substantially linear as a function of the at least one actuator position over a portion of the whole range of actuator positions.

5. The loudspeaker driver of claim 1, wherein it comprises means for determining the velocity of the at least one actuator that is axially moving within a magnetic gap of the loudspeaker driver based on the determined position of said at least one actuator and at least some of the sensing members output sensing data.

6. The loudspeaker driver of claim 1, wherein the position of the at least one actuator is determined based on at least one ratio X/Y, where X stands for output sensing data provided by a given sensing member or by a linear combination of sensing members output sensing data and Y stands for output sensing data provided by any other sensing member or any other linear combination of sensing members output sensing data, the output sensing data at the numerator and the denominator having the same power.

7. The loudspeaker driver of claim 6, wherein said at least one ratio (X/Y) may be selected among the following:

X and Y respectively stand for output sensing data Ui and Uj provided by two different sensing members, X/Y being then equal to Ui/Uj;

X stands for output sensing data Ui provided by a given sensing member and Y stands for a given linear combination of output sensing data provided by at least two sensing members;

X and Y respectively stand for two different linear combinations of sensing members output sensing data, each linear combination having the same power;

X stands for $Ui^n$, where Ui stands output sensing data provided by a given sensing member and n>1, and Y stands for a given linear combination of output sensing data provided by at least two sensing members with the same power n.

8. The loudspeaker driver of claim 1, wherein the plurality of sensing members is a plurality of sensing coils.

9. The loudspeaker driver of claim 1, wherein the at least one actuator is a voice-coil.

10. The loudspeaker driver of claim 9, wherein the voice-coil is suitable for axially moving within a magnetic gap of the loudspeaker driver and the plurality of sensing members are sensing coils affixed to the voice-coil.

11. The loudspeaker driver of claim 10, wherein the thickness of each sensing coil is small enough so that the voice-coil equipped with the plurality of sensing coils is suitable for axially moving within the magnetic gap without mechanically interfering with the edges thereof.

12. The loudspeaker driver of claim 10, wherein it comprises three sensing coils arranged one above each other, a lower, a medium and an upper sensing coil.

13. The loudspeaker driver of claim 12, wherein the height or axial dimension of the medium sensing coil is less than the height of the magnetic gap.

14. The loudspeaker driver of claim 1, wherein it comprises means for correcting the output sensing data provided by each sensing member to take into account the inductance factor Mci between the at least one actuator and each sensing member.

15. The loudspeaker driver of claim 14, wherein the at least one actuator is a voice coil, the plurality of sensing members is a plurality of sensing coils, and wherein said loudspeaker driver further comprises:

means for obtaining the electrical current $I_c$ in the voice-coil, and means for correcting the output sensing data provided by each sensing coil based on the inductance factor Mci between the voice-coil and each sensing coil and the variation in the current $I_c$ in time, $dI_c/dt$.

16. The loudspeaker driver of claim 15, wherein it comprises means for obtaining the inductance factor Mci between the voice-coil actuator and each sensing coil.

17. The loudspeaker driver of claim 16, wherein the means for obtaining the inductance factor Mci between the voice-coil and each sensing coil more particularly comprise:

means for generating a high frequency current signal having a predetermined amplitude, the frequency being so that the velocity of the voice-coil and its displacement induces a negligible measured signal in the sensing coils, means for measuring the voltage induced across each sensing coil, and means for obtaining the inductance factor Mci based on the measured induced voltage amplitude, the predetermined current amplitude and its frequency.

18. The loudspeaker driver of claim 1, wherein each sensing member provides a voltage signal as output sensing data.

19. A method for determining the position of at least one actuator connected to a vibrating support in a loudspeaker driver, the loudspeaker driver comprising a plurality of sensing members affixed to the at least one actuator and providing each output sensing data, wherein the method comprises:

causing the at least one actuator and the plurality of sensing members to move, the output sensing data provided by each sensing member being dependent on the velocity of said at least one actuator, determining at least one ratio X/Y of output sensing data or of linear combinations of output sensing data provided from the plurality of sensing members, said at least one ratio being independent of the velocity of the at least one actuator, and determining the position of the at least one actuator based on the determined at least one ratio.

20. The method of claim 19, wherein it comprises beforehand a calibration step, said calibration step comprising:

causing the at least one actuator and the plurality of sensing members to move so that the at least one actuator occupies a plurality of calibration positions, measuring each position of said plurality of calibration positions, determining for each measured position a corresponding calibration ratio (X/Y) of output sensing data or of linear combinations of output sensing data provided from the plurality of sensing members, and storing a plurality of couples of values each being formed by a value of a calibration position and a value of a calibration ratio.

21. The method of claim 20, wherein a position of the at least one actuator is then determined in the position determining step based on the determined at least one ratio and the stored plurality of couples of values.

22. The method of claim 20, wherein it further comprises determining parameters of at least one polynomial function from the plurality of previously determined couples of values so as to establish said at least one polynomial function, the position of the at least one actuator being then determined from the at least one polynomial function and the determined at least one ratio.

23. The method of claim 22, wherein it more particularly comprises determining parameters of two polynomial functions from the plurality of previously determined couples of values so as to establish said two polynomial functions, each polynomial function being adapted to cover a portion of the whole range of actuator positions, the polynomial functions being adapted to cover together the whole range of actuator positions.

24. The method of claim 19, wherein it comprises beforehand a calibration step, said calibration step comprising:

determining the radial magnetic field value Br(z) in a magnetic gap of the loudspeaker driver in which said at least one actuator is adapted to axially move, as a function of the axial position z, determining, for a plurality of calibration positions of the at least one actuator, the average magnetic field value to which each sensing member is subject to using the determined radial magnetic field value Br(z), determining, for each position of the plurality of calibration positions of the at least one actuator, a value taken by at least one function Mi depending on the determined average magnetic field values to which the plurality of sensing members are subject to in said position, the at least one function Mi establishing a correspondence between a calibration position of the at least one actuator and at least one ratio (X/Y) of output sensing data or of linear combinations of output sending data provided from the plurality of sensing members, storing the plurality of couples values each couple being formed by a value taken by the at least one function Mi X/Y and the corresponding calibration position.

25. The method of claim 24, wherein a position of the at least one actuator is then determined in the position determining step based on the determined at least one ratio and the stored plurality of couples of values.

26. The method of claim 24, wherein it further comprises determining parameters of at least one polynomial function from the plurality of previously determined couples of values so as to establish said at least one polynomial function, the position of the at least one actuator being then determined from the at least one polynomial function and the determined at least one ratio.

27. The method of claim 26, wherein it more particularly comprises determining parameters of two polynomial functions from the plurality of previously determined couples of values so as to establish said two polynomial functions, each polynomial function being adapted to cover a portion of the whole range of actuator positions, the polynomial functions being adapted to cover together the whole range of actuator positions.

28. A method for determining the velocity of at least one actuator connected to a vibrating support in a loudspeaker driver, the loudspeaker driver comprising at least one sensing member affixed to the at least one actuator and providing output sensing data, wherein the method comprises:

causing the at least one actuator and the at least one sensing member to move, the output sensing data provided by the or each sensing member being dependent on the velocity of said at least one actuator, determining the output sensing data or the sum of the output sensing data $U_{tot}$ provided by the one or plurality of sensing member(s);

determining the position of the at least one actuator; and determining the velocity of the at least one actuator based on the determined value of output sensing data or the sum of the output sensing data $U_{tot}$ and the determined position.

29. The method of claim 28, wherein it comprises beforehand a calibration step, said calibration step comprising:

causing the at least one actuator and the at least one sensing member to move so that the at least one actuator occupies a plurality of calibration positions, obtaining each position $d_c$ of said plurality of calibration positions, determining for each calibration position a calibration value $UC_{tot}$, corresponding to output sensing data or to the sum of output sensing data provided by the one or the plurality of sensing member(s), and a velocity v of the at least one actuator; and storing a plurality of triplets of values (v, $UC_{tot}$, $d_c$) formed each by one determined calibration value $UC_{tot}$, one obtained calibration position $d_c$ and the corresponding determined velocity v.

30. The method of claim 29, wherein a velocity of the at least one actuator is then determined in the step of determining the velocity based on the determined value $U_{tot}$ provided by the one or the plurality of sensing members, the determined position and the stored plurality of triplets of values (v, $UC_{tot}$, $d_c$).

31. The method of claim 28, wherein it comprises beforehand a calibration step, said calibration step comprising:

determining the radial magnetic field value Br(z) in a magnetic gap of the loudspeaker driver in which said at least one actuator is adapted to axially move, as a function of the axial position z, determining, for a plurality of calibration positions $d_c$ of the at least one actuator, the average overall radial magnetic field value $<Br>_{tot}$ ($d_c$) to which the at least one sensing member is subject to using the determined radial magnetic field value Br(z), determining, for a plurality of calibration values of $UC_{tot}$ chosen for each position of the plurality of calibration positions, several values of the velocity v based on the plurality of values of $<Br>_{tot}(d_c)$ and $UC_{tot}$; and storing the plurality of triplets of values (v, $UC_{tot}$, $d_c$) formed each by one chosen calibration value $UC_{tot}$, one calibration position $d_c$ and the corresponding determined velocity v.

32. The method of claim 31, wherein a velocity of the at least one actuator is then determined in the step of determining the velocity based on the determined value $U_{tot}$ provided by the one or the plurality of sensing members, the determined position and the stored plurality of triplets of values (v, $UC_{tot}$, $d_c$).

* * * * *